US006508168B1

(12) United States Patent
Takahashi et al.

(10) Patent No.: US 6,508,168 B1
(45) Date of Patent: Jan. 21, 2003

(54) STENCIL PRINTER

(75) Inventors: Yasuhiro Takahashi, Inashiki-gun (JP); Hideaki Nogi, Inashiki-gun (JP); Yoshikazu Hara, Inashiki-gun (JP); Koichi Oyama, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/630,547

(22) Filed: Aug. 1, 2000

(30) Foreign Application Priority Data

Aug. 2, 1999 (JP) ..... 11-218839

(51) Int. Cl.[7] ..... B41L 13/00
(52) U.S. Cl. ..... 101/120; 101/116
(58) Field of Search ..... 101/114, 116, 101/119, 120, 129

(56) References Cited

U.S. PATENT DOCUMENTS

| | | | | |
|---|---|---|---|---|
| 4,911,069 A | | 3/1990 | Hayama et al. | |
| 5,081,924 A | | 1/1992 | Ohinata | |
| 5,239,922 A | * | 8/1993 | Zimmer | 101/120 |
| 5,575,204 A | * | 11/1996 | Kawai et al. | 101/116 |
| 5,601,019 A | | 2/1997 | Ohinata et al. | |
| 5,603,260 A | * | 2/1997 | Ohinata et al. | 101/129 |
| 5,671,670 A | * | 9/1997 | Takahashi et al. | 101/116 |
| 6,213,014 B1 | * | 4/2001 | Motoe et al. | 101/116 |
| 6,247,401 B1 | * | 6/2001 | Sato et al. | 101/116 |

FOREIGN PATENT DOCUMENTS

| | | |
|---|---|---|
| DE | 41 28 700 A1 | 3/1993 |
| EP | 0 046 951 A1 | 8/1981 |
| EP | 0715 962 A1 | 6/1996 |
| GB | 2 241 672 A | 9/1991 |
| JP | A7-322061 | 12/1995 |

* cited by examiner

*Primary Examiner*—Ren Yan
(74) *Attorney, Agent, or Firm*—Nixon Peabody LLP; Donald R. Studebaker

(57) ABSTRACT

A stencil printer includes a printing drum which has an ink-permeable peripheral wall and is rotated about a predetermined axis of rotation with a stencil master wound around the peripheral wall, a back press roll which associates with the printing drum to nip and convey a printing paper, and an internal press roll which is provided in the printing drum to be movable back and forth toward and away from the back press roll and pushes the peripheral wall of the printing drum toward the back press roll. An internal press roll drive mechanism moves back and forth the internal press roll between a first position where the internal press roll is held away from the back press roll and a second position at a distance from the first position toward the back press roll and is able to freely change the distance between the axis of rotation of the printing drum and the second position.

18 Claims, 29 Drawing Sheets

STENCIL PRINTER

BACKGROUND OF THE INVENTION

1. Field of the Invention

This invention relates to a stencil printer, and more particularly to a stencil printer in which an internal press roll presses the peripheral wall of a printing drum against a back press roll when printing is done.

2. Description of the Related Art

There has been known a type of a stencil printer comprising a printing drum which has an ink-permeable peripheral wall and is rotated with a stencil master wound around the peripheral wall, a back press roll which presses a printing paper against the printing drum and conveys the printing paper together with the printing drum, and an internal press roll which is provided in the printing drum to be movable back and forth toward and away from the back press roll and pushes the peripheral wall of the printing drum toward the back press roll. See, for instance, Japanese Unexamined Patent Publication No. 1(1989)-204781. In the stencil printer of this type, the internal press roll is supported for rotation about its central axis by a pair of arm members which are rotated about an axis which is parallel to the axis of rotation of the printing drum and offset therefrom. The arm members are rotated between a retracted position where the internal press roll is held just in contact with the inner surface of the peripheral wall of the printing drum or away therefrom and a printing position where the internal press roll pushes a part of the peripheral wall of the printing drum toward the back press roll. The printing drum with a stencil master wound around the peripheral wall thereof and the back press roll are rotated in opposite directions with a part of the peripheral wall of the printing drum pressed against the back press roll by the internal press roll and a printing paper is fed between the back press roll and the part of the peripheral wall of the printing drum pressed against the back press roll, whereby ink supplied to the inner surface of the peripheral wall of the printing drum is transferred to the printing paper through the stencil master which has been perforated in a pattern of image to be printed, and printing is done.

Further, there has been proposed, as disclosed in Japanese Unexamined Patent Publication No. 3(1991)-254984, a stencil printer in which the internal press roll is driven by way of a gear train to rotate in synchronization with the printing drum and the arm members are rotated between the retracted position and the printing position under force which acts on the internal press roll by way of the gear train. In this stencil printer, the internal press roll is not rotated by way of friction between the internal press roll and the peripheral wall of the printing drum with ink intervening therebetween but is actively rotated by way of the gear train in synchronization with the printing drum at a predetermined speed ratio to the printing drum so that the degree of squeezing action between the internal press roll and the peripheral wall of the printing drum is stabilized.

Further, as disclosed in Japanese Unexamined Patent Publication No. 8(1996)-207416, there has been proposed a stencil printer in which the printing pressure is optimized by controlling flow of force transmitted to the internal press roll through the gear train, and thereby controlling the amount by which the internal press roll pushes the peripheral wall of the printing drum toward the back press roll.

However, in such a stencil printer where the internal press roll is driven in synchronization with rotation of the printing drum, the internal press roll urging force is obtained from the rotating force of the printing drum, and accordingly, the internal press roll urging force fluctuates according to the printing speed, the viscosity of ink and the like, which gives rise to a problem that it is difficult to stably obtain a proper printing pressure. That is, as the printing speed increases, the rotational speed of the printing drum increases and the internal press roll urging force increases. As a result, the amount by which the peripheral wall of the printing drum is pushed toward the back press roll increases and the printing pressure increases. Further, the ink to be supplied to the printing drum is supplied to the internal press roll while being stirred by an ink agitator which is driven in synchronization with rotation of the printing drum, and accordingly, when the viscosity of the ink increases because of, for instance, a low ambient temperature of the stencil printer, rotating torque of the printing drum is increased and the internal press roll urging force is increased, which results in a high printing pressure.

Further, a stencil master seat for fixing a stencil master is mounted on the printing drum, and in order to prevent the stencil master seat from being jammed between the internal press roll and the back press roll, the internal press roll must be moved away from the back press roll when the printing drum is rotated to a position where the stencil master seat is opposed to the back press roll. Further also when printing is temporarily interrupted, the internal press roll must be held away from the back press roll. In this case, since the printing drum is kept rotated and the internal press roll is kept urged toward the back press roll, the internal press roll must be moved away from the back press roll overcoming the urging force. As a result, an excessive force acts on the components of the printing drum such as the gear train and deteriorates durability of such components.

Since the internal press roll extends in a direction transverse to the direction of movement of the printing paper (in the direction of width of the printing paper), it is necessary to increase dimensional accuracy and assembling accuracy of the components of the stencil printer such as the internal press roll, the members for supporting the internal press roll, the gear train and the like in order to obtain a uniform printing pressure in the direction of width of the printing paper and it has been impossible to obtain a uniform printing pressure in the direction of width of the printing paper after the stencil printer is manufactured. Depending upon the kind of printings, it is sometimes desirable that printing can be done in different densities in the direction of width of the printing paper.

SUMMARY OF THE INVENTION

In view of the foregoing observations and description, the primary object of the present invention is to provide a stencil printer in which a desired printing pressure can be easily obtained.

In accordance with the present invention, there is provided a stencil printer comprising a printing drum which has an ink-permeable peripheral wall and is rotated about a predetermined axis of rotation with a stencil master wound around the peripheral wall, a back press roll which associates with the printing drum to nip and convey a printing paper, and an internal press roll which is provided in the printing drum to be movable back and forth toward and away from the back press roll and pushes the peripheral wall of the printing drum toward the back press roll, wherein the improvement comprises an internal press roll drive means which moves back and forth the internal press roll between a first position where the internal press roll is held away from the back press roll and a second position at a distance from the first position toward the back press roll and is able to freely change the distance between the axis of rotation of the printing drum and the second position.

It is preferred that the internal press roll drive means is provided with a means for moving opposite ends of the internal press roll independently of each other.

It is preferred that the stencil printer further comprises a printing speed setting means for setting the printing speed and the internal press roll drive means changes the distance between the axis of rotation of the printing drum and the second position according to the printing speed set by the printing speed setting means.

Further it is preferred that the stencil printer further comprises an ink temperature detecting means which detects the temperature of the ink and the internal press roll drive means changes the distance between the axis of rotation of the printing drum and the second position according to the temperature of the ink detected by the ink temperature detecting means.

In this case, it is preferred that the ink temperature detecting means detects the temperature of the ink through the ambient temperature of the printing drum, the temperature inside the printing drum or the ambient temperature of the stencil printer.

Further it is preferred that the stencil printer further comprises an ink temperature input means for manually inputting a temperature of the ink, and the internal press roll drive means changes the distance between the axis of rotation of the printing drum and the second position according to the temperature of the ink input through the ink temperature input means.

In this case, it is preferred that the temperature of the ink be represented by the ambient temperature of the printing drum, the temperature inside the printing drum or the ambient temperature of the stencil printer.

Further, it is preferred that the stencil printer further comprises an ink viscosity detecting means which detects the viscosity of the ink and the internal press roll drive means changes the distance between the axis of rotation of the printing drum and the second position according to the viscosity of the ink detected by the ink viscosity detecting means.

In this case, it is preferred that the ink viscosity detecting means detects the viscosity of the ink through the electric current supplied to the electric motor for driving the printing drum or to the electric motor for supplying the ink to the printing drum.

Further it is preferred that the stencil printer further comprises an ink viscosity input means for manually inputting a viscosity of the ink, and the internal press roll drive means changes the distance between the axis of rotation of the printing drum and the second position according to the viscosity of the ink input through the ink viscosity input means.

In this case, it is preferred that the viscosity of the ink be represented by the electric current supplied to the electric motor for driving the printing drum or to the electric motor for supplying the ink to the printing drum.

Further it is preferred that the stencil printer further comprises a wear detecting means which detects the amount of wear of the internal press roll and the internal press roll drive means changes the distance between the axis of rotation of the printing drum and the second position according to the amount of wear of the internal press roll detected by the wear detecting means.

In this case, it is preferred that the wear detecting means detects the amount of wear of the internal press roll on the basis of the cumulative number of times of printing.

Further it is preferred that the stencil printer further comprises a wear input means for manually inputting the amount of wear of the internal press roll, and the internal press roll drive means changes the distance between the axis of rotation of the printing drum and the second position according to the amount of wear of the internal press roll input through the wear input means.

In this case, it is preferred that the amount of wear be estimated on the basis of the cumulative number of times of printing.

Further it is preferred that the stencil printer further comprises an original type setting means which sets the type of the original, and the internal press roll drive means changes the distance between the distance between the axis of rotation of the printing drum and the second position to the type of the original set by the original type setting means.

Further it is preferred that the stencil printer further comprises an original type input means for manually inputting the type of the original, and the internal press roll drive means changes the distance between the axis of rotation of the printing drum and the second position according to the type of the original input through the original type input means.

Further, it is preferred that the internal press roll drive means comprises

- a support member which supports opposite ends of the internal press roll and is rotatable about a predetermined axis of rotation,
- a cam member which is in abutment against the support member and is rotated to move up and down the support member, and
- a rotation control means which controls the amount of rotation of the cam member.

It is preferred that the rotation control means be a pulse motor.

In the stencil printer of the present invention, the distance between the axis of rotation of the printing drum and the second position can be freely changed, that is, the distance of the internal press roll from the back press roll when the internal press roll is in the second position can be freely changed. Accordingly, the printing pressure can be optimized by changing the distance between the axis of rotation of the printing drum and the second position according to the printing speed, the viscosity of ink and the like. Further by changing the distance between the axis of rotation of the printing drum and the second position so that the internal press roll is held away from the peripheral wall of the printing drum even in the second position, an excessive force cannot act on the components of the printing drum when the internal press roll is moved away from the back press roll in order to prevent the stencil master seat from being jammed between the internal press roll and the back press roll or to temporarily interrupt printing, whereby durability of the components can be increased.

When the internal press roll drive means is provided with a means for moving opposite ends of the internal press roll independently of each other, the distances between the axis of rotation of the printing drum and the second position at opposite ends of the internal press roll can be made different from each other, whereby the printing pressure can be easily made uniform even if dimensional accuracy and assembling accuracy of the components of the stencil printer are not so high. Further printing can be done in different densities in the direction of width of the printing paper.

Further, by changing the distance between the axis of rotation of the printing drum and the second position according to the printing speed set by a printing speed setting means, a desired printing pressure can be obtained irrespective of the printing speed.

Further, by changing the distance between the axis of rotation of the printing drum and the second position according to the temperature of the ink detected by an ink temperature detecting means or the temperature of the ink input through an ink temperature input means, a desired printing pressure can be obtained irrespective of the ink temperature.

Further, by changing the distance between the axis of rotation of the printing drum and the second position according to the viscosity of the ink detected by an ink viscosity detecting means or the viscosity of the ink input through an ink viscosity input means, a desired printing pressure can be obtained irrespective of the ink viscosity.

Further, by changing the distance between the axis of rotation of the printing drum and the second position according to the amount of wear of the internal press roll by a wear detecting means or the amount of wear of the internal press roll input through a wear input means, a desired printing pressure can be obtained irrespective of the diameter of the internal press roll which changes with wear.

Further, by changing the distance between the axis of rotation of the printing drum and the second position according to the type of the original set by an original type setting means or input through an original type input means, a desired printing pressure can be obtained irrespective of the type of the original.

When the internal press roll drive means comprises a support member which supports the internal press roll, a cam member which is in abutment against the support member and is rotated to move up and down the support member, and a rotation control means which controls the amount of rotation of the cam member, the distance between the axis of rotation of the printing drum and the second position can be changed by simply changing the amount of rotation of the cam member and the internal press roll drive means can be simple in structure.

When the rotation control means comprises a pulse motor, the distance between the axis of rotation of the printing drum and the second position can be easily changed by simply changing the number of pulses supplied to the pulse motor.

DESCRIPTION OF THE PREFERRED EMBODIMENT

Figure 1:
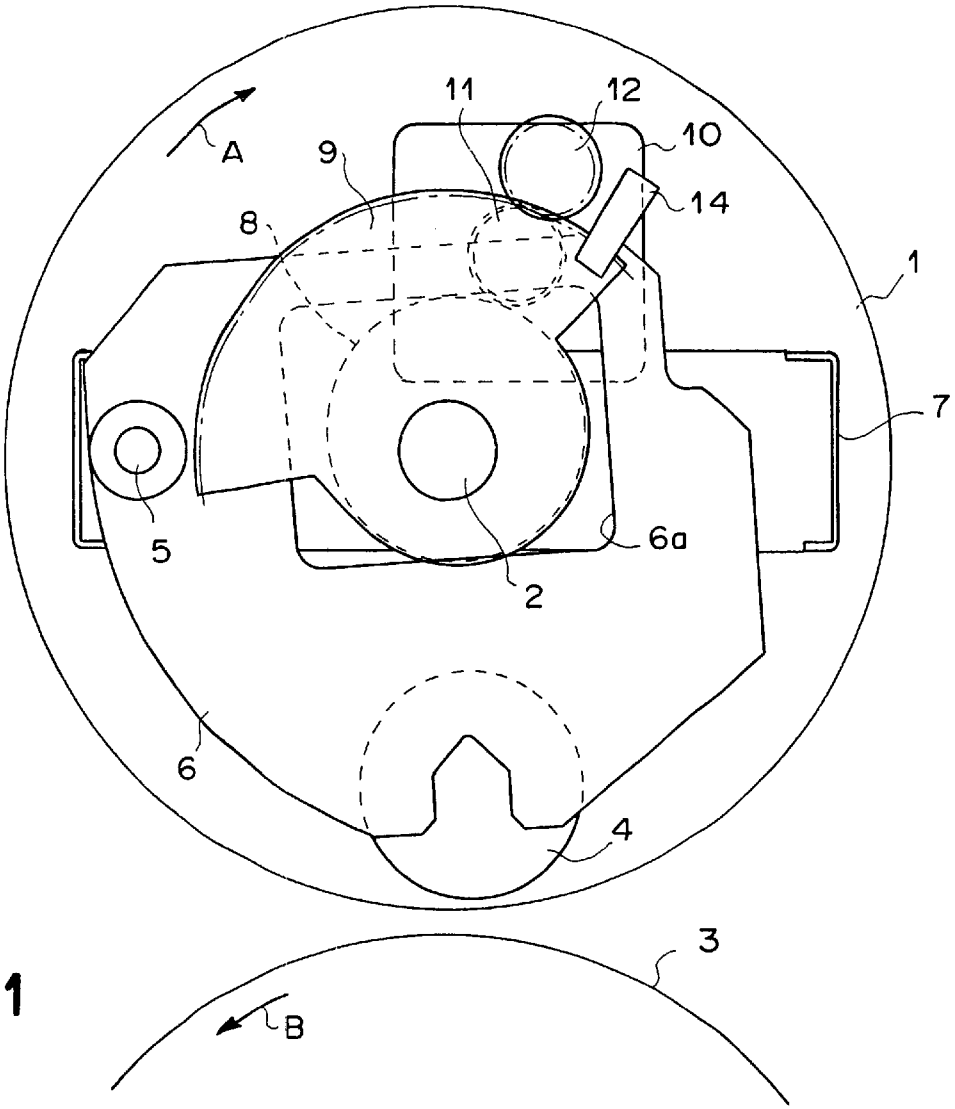
FIG. 1 is a side view showing the structure of the printing drum of a stencil printer in accordance with an embodiment of the present invention.
Figure 2:
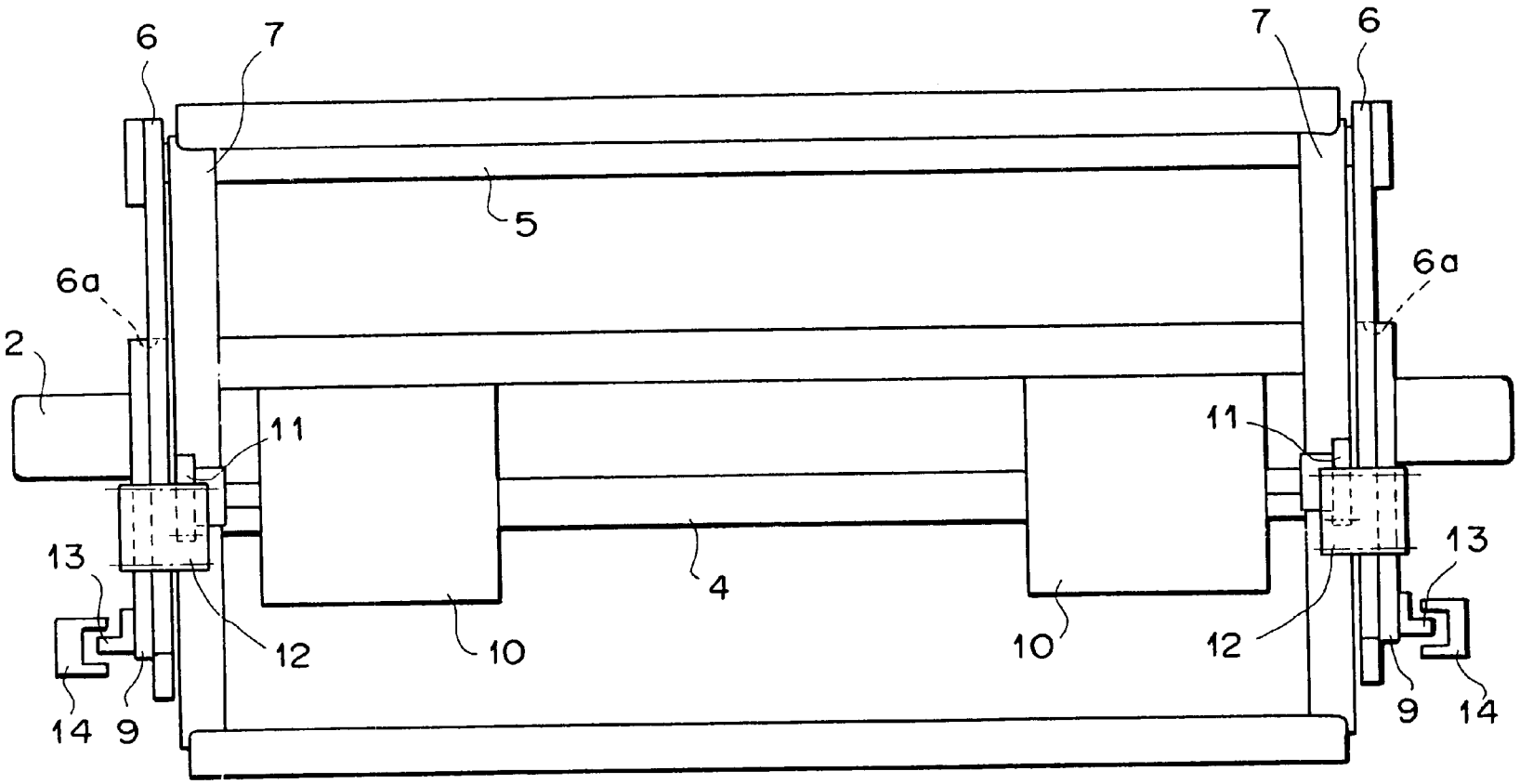
FIG. 2 is a plan view of the printing drum with its peripheral wall removed.
Figure 3:
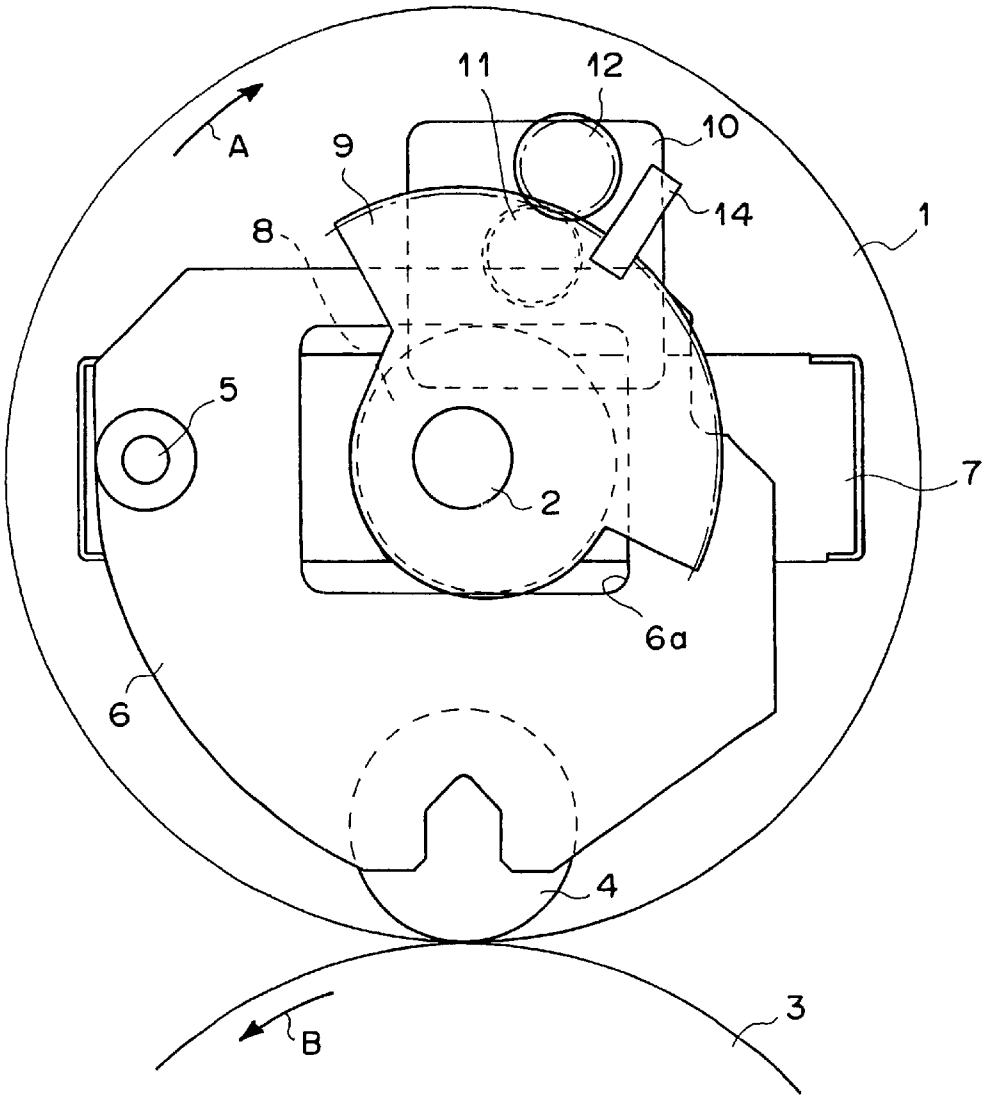
FIG. 3 is a view similar to FIG. 1 but showing a state when printing is effected.

In FIGS. 1 to 3, a stencil printer in accordance with an embodiment of the present invention comprises a printing drum 1 which is substantially cylindrical and is supported for rotation about a rotating shaft 2. The printing drum 1 has a peripheral wall which is ink-permeable and flexible. The peripheral wall of the printing drum 1 is formed by rolling knitting or web of wire, or a perforated rectangular thin sheet into a cylinder having a central axis along the rotating shaft 2. The rotating shaft 2 is supported for rotation on a frame 7 and is driven by a printing drum motor (not shown), whereby the printing drum 1 is rotated about the rotating shaft 2. In FIG. 2, the peripheral wall of the printing drum 1 is removed.

A back press roll 3 is provided in a predetermined position below the printing drum 1. The back press roll 3 is provided with a drive shaft (not shown) parallel to the rotating shaft 2 of the printing drum 1. When printing is not effected, the back press roll 3 is held opposed to the printing drum 1 with a gap intervening therebetween. When printing is effected, the printing drum 1 and the back press roll 3 are rotated in opposite directions. That is, the printing drum 1 is rotated in the clockwise direction as shown by arrow A and the back press roll 3 is rotated in the counterclockwise direction as shown by arrow B.

An internal press roll 4 is provided in the printing drum 1. The internal press roll 4 is formed of an elastic material such as rubber and pushes a part of the peripheral wall of the printing drum 1 toward the back press roll 3 from inside the peripheral wall. The internal press roll 4 is supported for rotation at its opposite ends on a pair of base plates 6 which are supported for rotation about a support shaft 5. The support shaft 5 is supported on the frame 7 at a distance from the rotating shaft 2 of the printing drum 1 in parallel thereto. The internal press roll 4 is driven by the printing drum motor by way of the rotating shaft 2 and a gear train (not shown).

Each of the base plates 6 is provided with an opening 6*a* and an eccentric cam 8 which is rotated about the rotating shaft 2 is in engagement with the opening 6*a*. The eccentric cam 8 is formed integrally with a sector gear 9 which is rotated about the rotating shaft 2. Driving force of a pulse motor 10 is transmitted to the sector gear 9 by way of a motor gear 11 and an idler gear 12, whereby the sector gear 9 and the eccentric cam 8 are rotated. Since the eccentric cam 8 is in engagement with the opening 6*a* of the base plate 6 on each end of the internal press roll 4 as described above, the base plates 6 are rotated about the support shaft 5 as the eccentric cam 8 is rotated and the internal press roll 4 is moved.

The position of the internal press roll 4 where the internal press roll 4 is held away from the peripheral wall of the printing drum 1 and a gap is formed between the outer surface of the peripheral wall of the printing drum 1 and the back press roll 3 as shown in FIG. 1 will be referred to as "the initial position". An L-shaped light-shielding plate 13 is mounted on the sector gear 9 and a sensor 14 which is U-shaped in cross-section is disposed in a position where the light-shielding plate 13 is inserted into the sensor 14 to turn on the output of the sensor 14 when the internal press roll 4 is in the initial position. When the internal press roll 4 is not in the initial position, the light-shielding plate 13 is away from the sensor 14 and the output of the sensor 14 is turned off.

Figure 4:
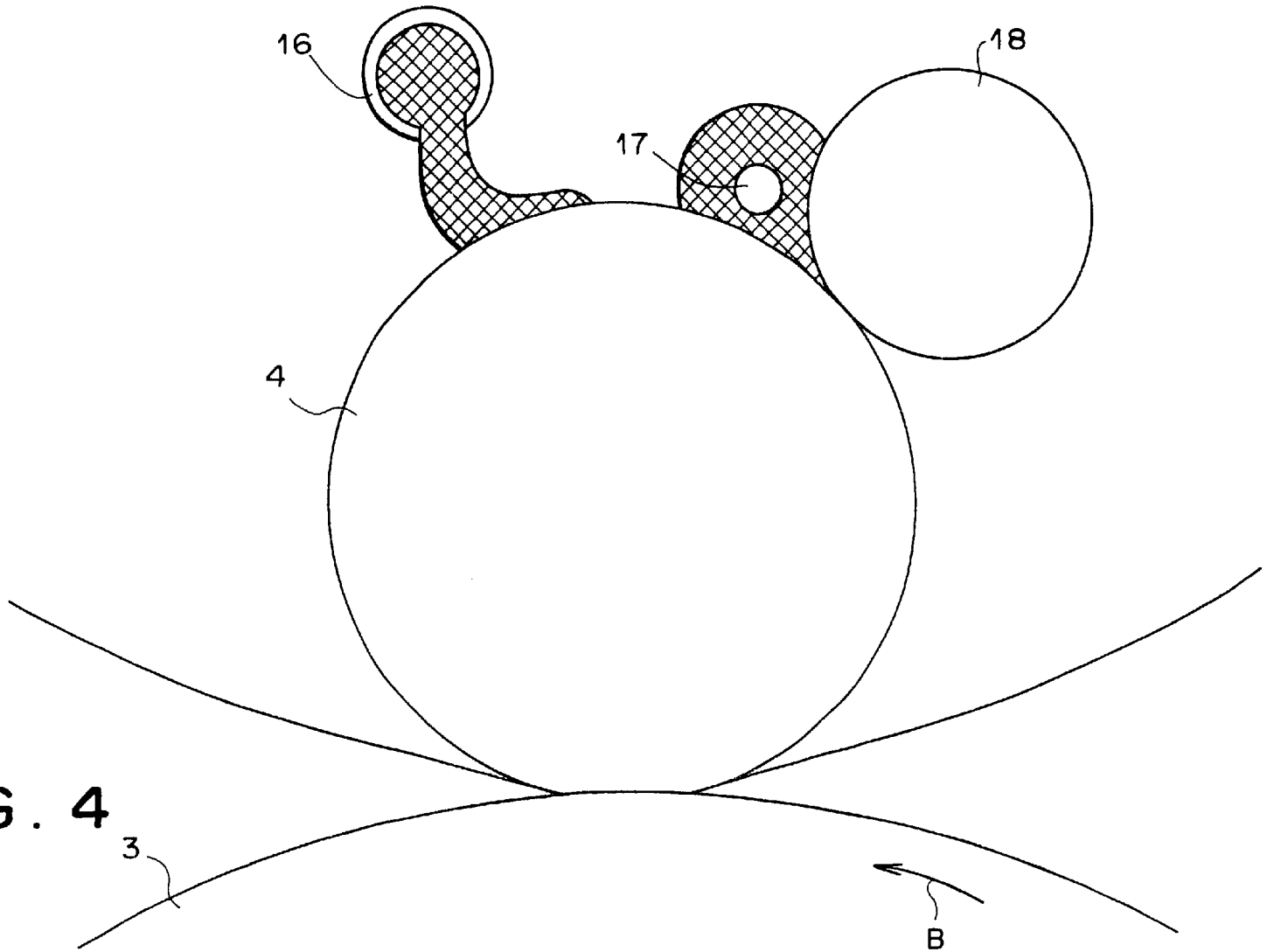
FIG. 4 is a fragmentary enlarged side view showing the part around the internal press roll.

When the pulse motor 10 is driven by a control means to be described later, the sector gear 9 is rotated by way of the motor gear 11 and the idler gear 12 and the eccentric cam 8 is rotated, whereby the internal press roll 4 is moved from the initial position shown in FIG. 1 to an operative position (printing position) shown in FIG. 3. Then as shown in FIG. 4, ink is supplied to the internal press roll 4 through an ink supply port 16 by an ink pump (not shown). An ink agitator rod 17 is disposed near the internal press roll 4 to agitate the supplied ink. The supplied ink is agitated by the ink agitator rod 17 and is uniformly coated on the surface of the internal press roll 4 by a doctor roll 18. In this state, printing is effected. The distance of the internal press roll 4 from the rotating shaft 2 of the printing drum 1 when the internal press roll 4 is in the operative position, that is, the amount by which the internal press roll 4 is moved from the initial position (this will be referred to as "the amount of ejection of the internal press roll 4", hereinbelow), can be changed by changing the amount of rotation of the eccentric cam 8. The amount of rotation of the eccentric cam 8 can be changed by changing the number of pulses to be input into the pulse motor 10. In this particular embodiment, the pulse motor 10 is provided on each end of the internal press roll 4, and accordingly, by separately controlling the numbers of pulses to be input into the pulse motors 10, the amount of ejection of the internal press roll 4 can be differently controlled at the opposite ends of the internal press roll 4.

Figure 5:
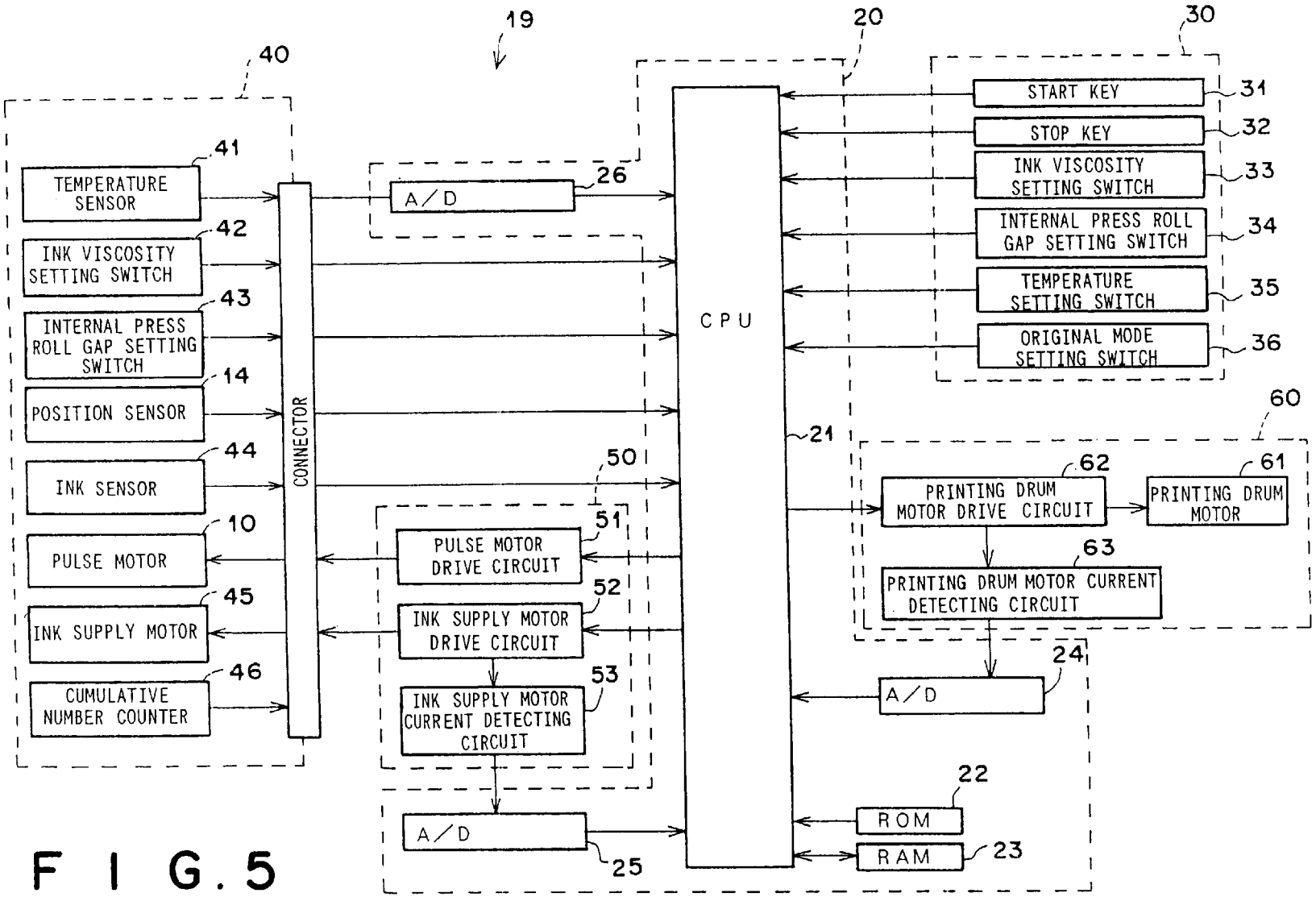
FIG. 5 is a block diagram showing the structure of the control means.
Figure 6:
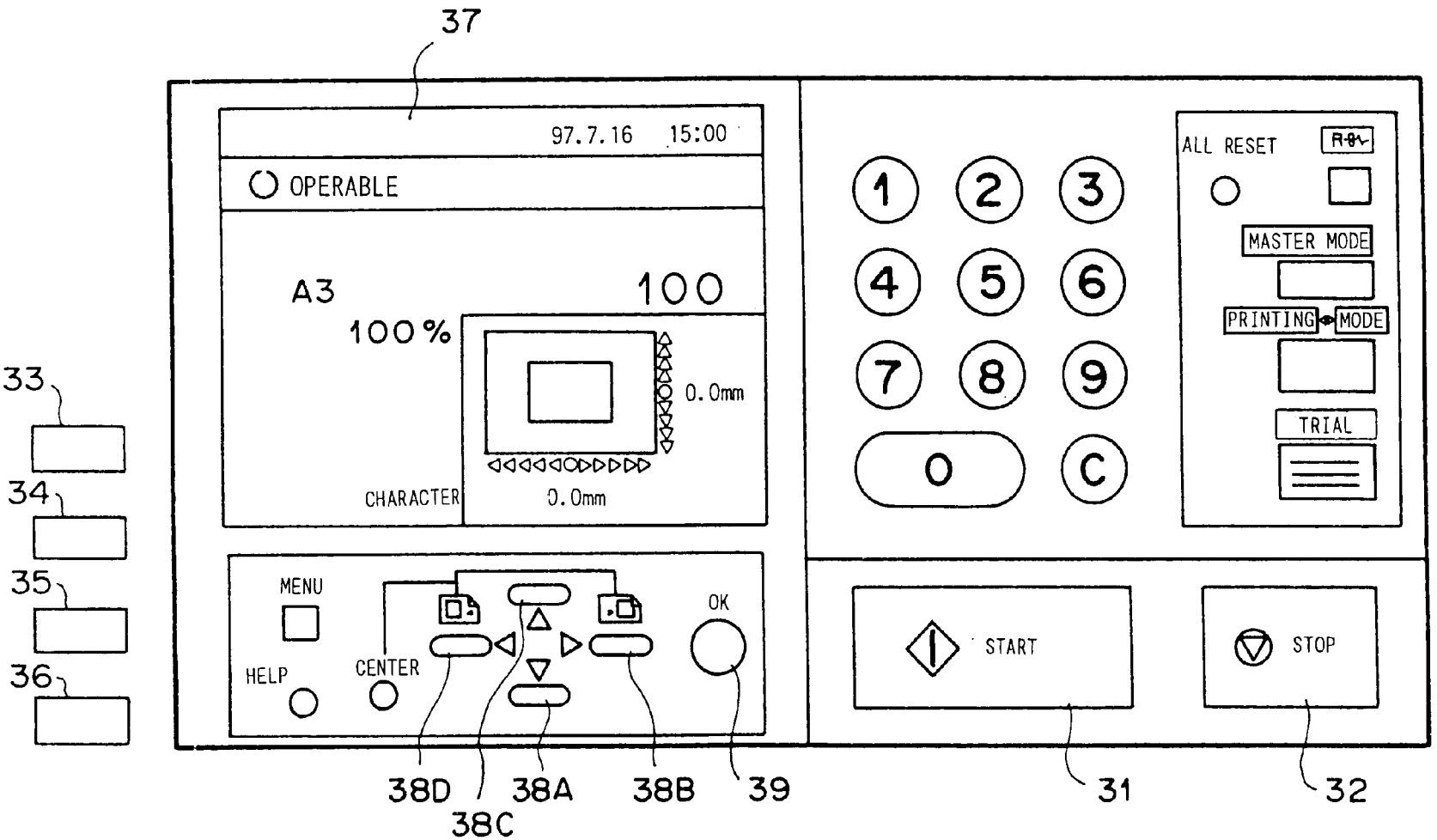
FIG. 6 is a view showing the initial state of the display on the control panel.

FIG. 5 shows the structure of the control means for controlling the amount of rotation of the pulse motor 10. As shown in FIG. 5, the control means 19 comprises a one-chip microcomputer 20, a control panel 30, an in-drum mechanism 40, a drive section 50 and a printing drum drive section 60.

The one-chip microcomputer 20 comprises a CPU 21, a ROM 22 in which control program is stored, a RAM 23 for storing operating variables of the CPU 21 and the like, a first A/D converter 24 which digitizes the value of an electric current supplied to a printing drum motor for driving the printing drum 1 in order to detect the viscosity of ink on the basis of the digitized value of the electric current supplied to the printing drum motor, a second A/D converter 25 which digitizes the value of an electric current supplied to an ink supply motor to be described later in order to detect the viscosity of ink on the basis of the digitized value of the electric current supplied to the ink supply motor, and a third A/D converter 26 which digitizes the value of an electric signal from a temperature sensor to be described later in order to detect the temperature inside the printing drum 1 on the basis of the digitized value of the electric signal.

The control panel 30 comprises a start key 31 for starting printing, a stop key 32 for interrupting printing, an ink viscosity setting switch 33 for setting viscosity of ink, an internal press roll gap setting switch 34 for setting the width of the gap between the internal press roll 4 and the doctor roll 18, a temperature setting switch 35 for setting a temperature such as the temperature of environment in which the stencil printer is installed, and an original mode setting switch 36 for setting the kind of the original to be used in printing as an original mode.

As shown in FIGS. 6 to 10, the control panel 30 further comprises an LCD panel 37, selection keys 38A to 38D and a verification key 39. Various frames are displayed by the LCD panel 37 and the operator can execute desired settings by operating the selection keys 38A to 38D and the verification key 39 under the guidance shown in the frames.

Figure 7:
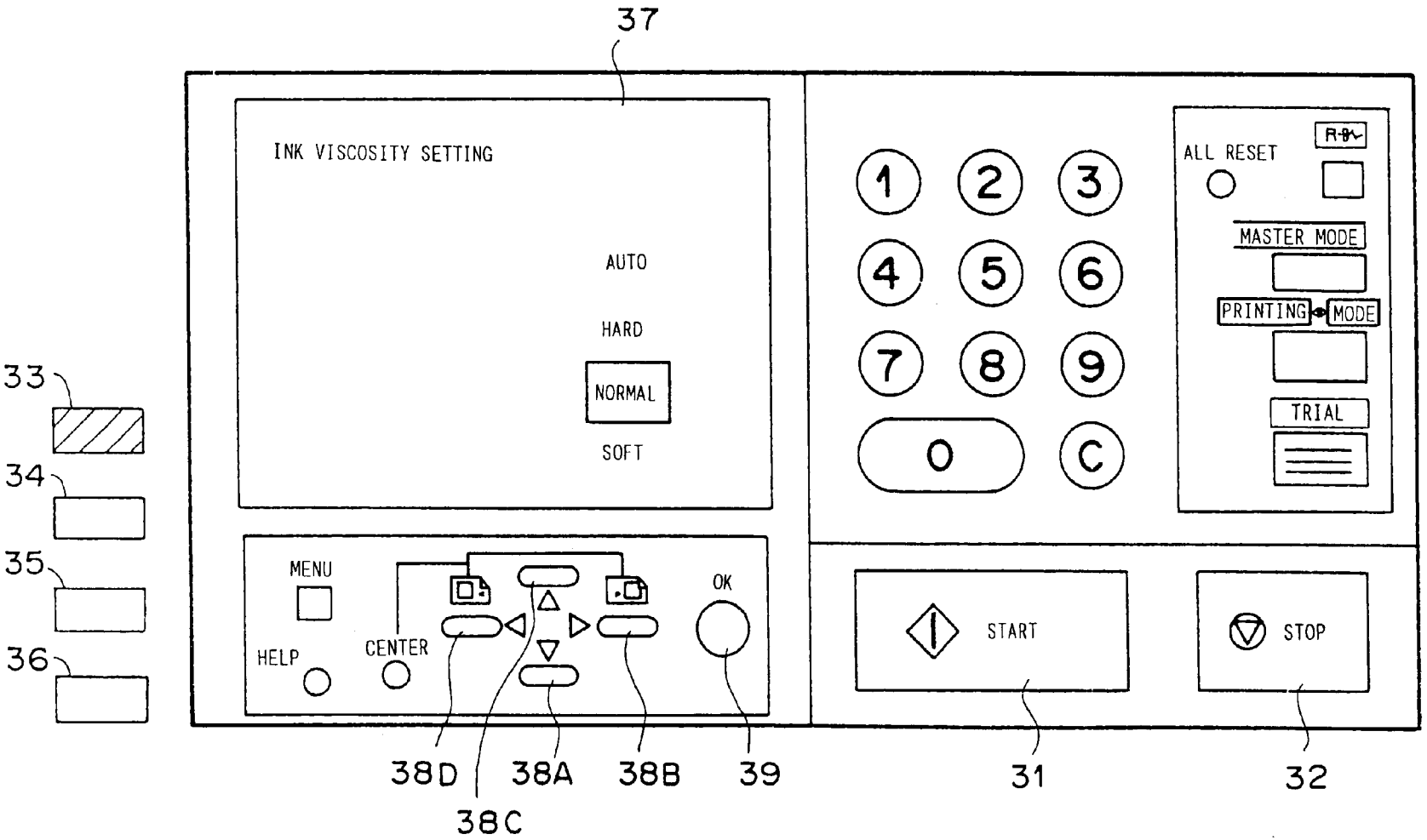
FIG. 7 is a view showing the state of the display on the control panel when setting the viscosity of the ink.

When the ink viscosity setting switch 33 is depressed, an ink viscosity setting frame shown in FIG. 7 appears on the LCD panel 37. One of "auto", "hard", "normal" and "soft" is selected by operating the selection keys 38A to 38D, and the selected ink viscosity is reversed. Then by depressing the verification key 39, the selected ink viscosity is verified and the initial frame shown in FIG. 6 is displayed again. In FIGS. 7 to 10, the selected terms to be shown in reverse video are shown as surrounded by a rectangle.

Figure 8:
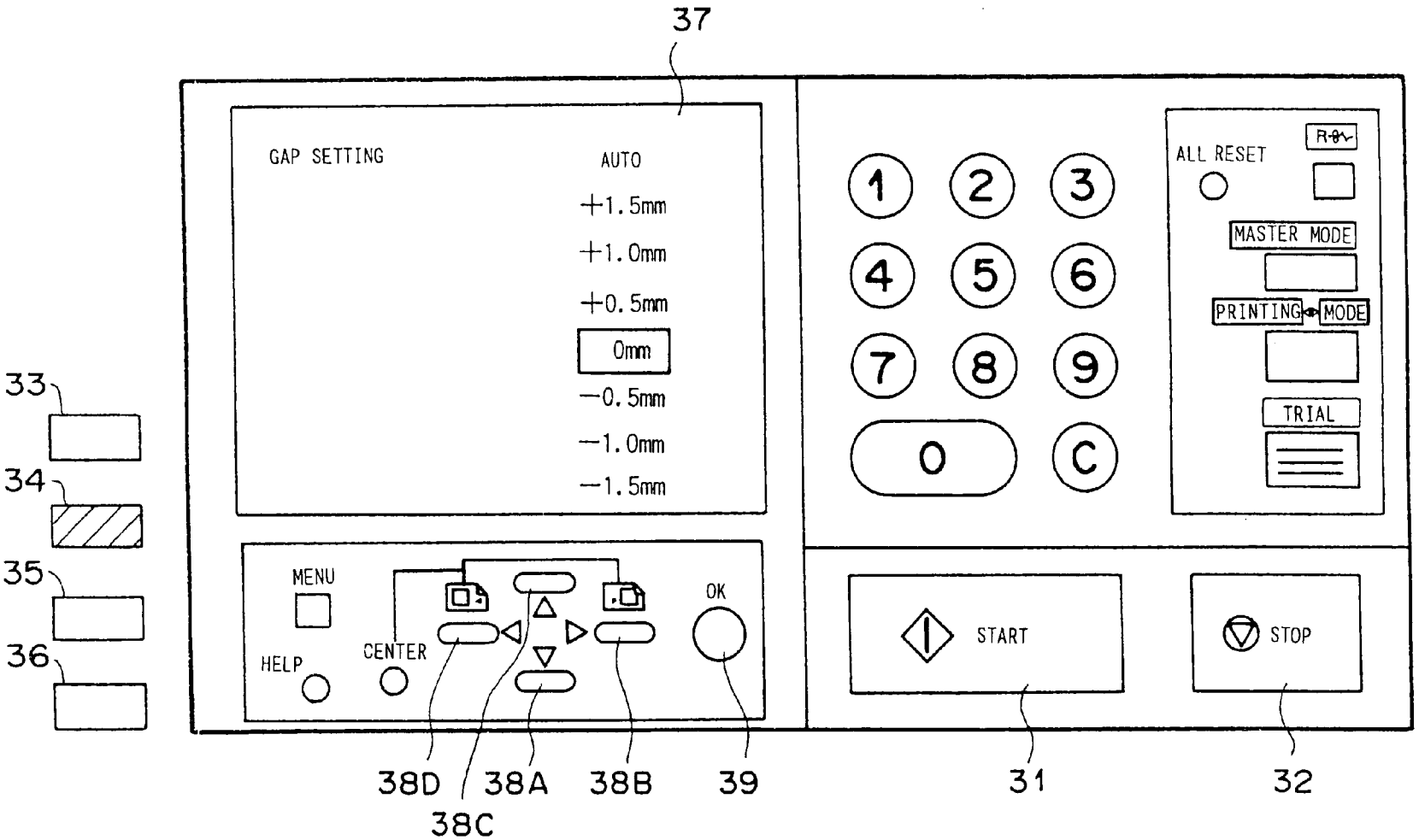
FIG. 8 is a view showing the state of the display on the control panel when setting the gap.

When the internal press roll gap setting switch 34 is depressed, an internal press roll gap setting frame shown in FIG. 8 appears on the LCD panel 37. One of the values of the width of the gap between the internal press roll 4 and the doctor roll 18 is selected by operating the selection keys 38A to 38D, and the selected value of the width of the gap is reversed. Then by depressing the verification key 39, the selected value of the width of the gap is verified and the initial frame shown in FIG. 6 is displayed again.

Figure 9:
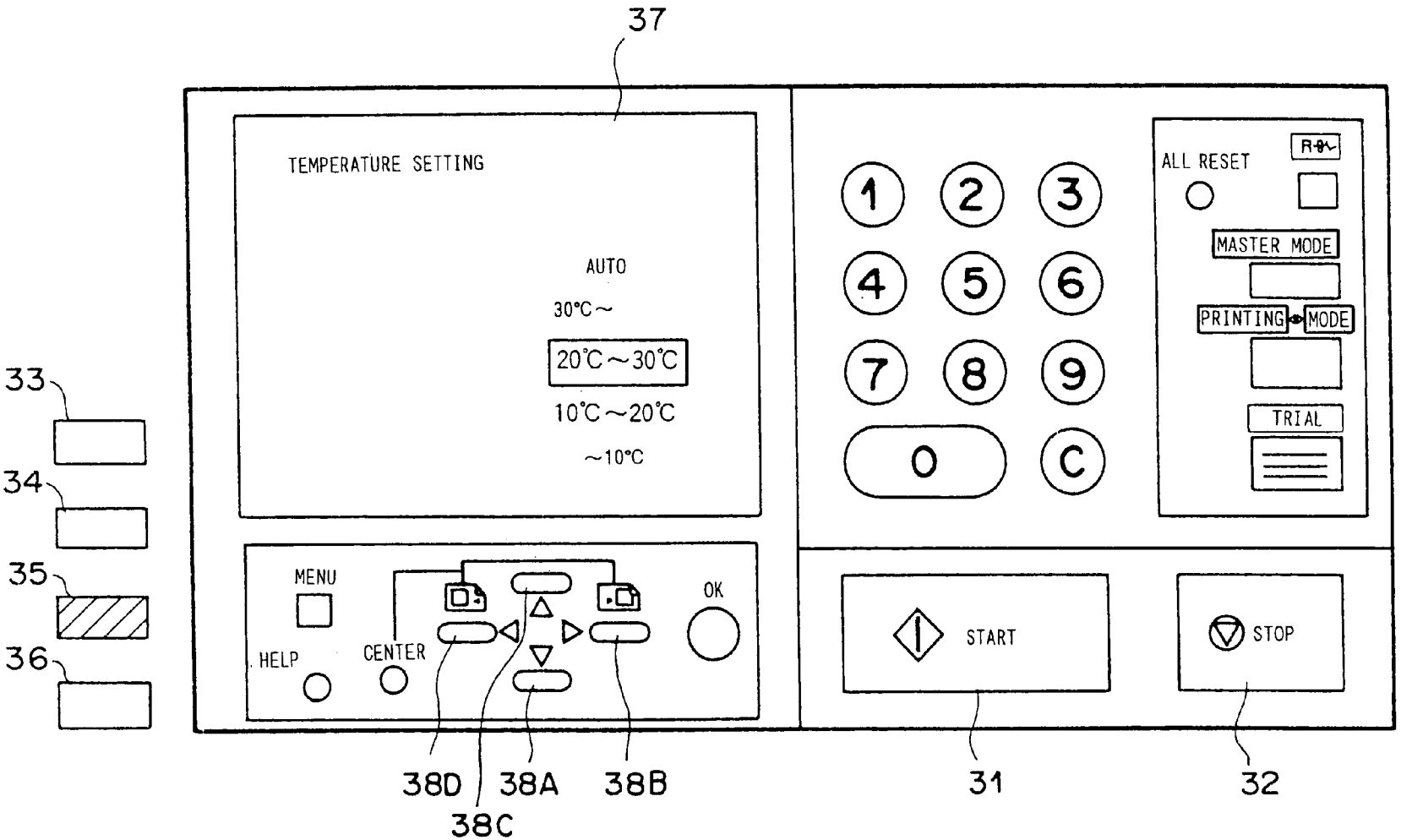
FIG. 9 is a view showing the state of the display on the control panel when setting the temperature.

When the temperature setting switch 35 is depressed, a temperature setting frame shown in FIG. 9 appears on the LCD panel 37. One of "auto", "not lower than 30° C.", "20° C.–30° C.", "10° C.–20° C." and "lower than 10° C." is selected by operating the selection keys 38A to 38D, and the selected temperature is reversed. Then by depressing the verification key 39, the selected temperature is verified and the initial frame shown in FIG. 6 is displayed again. Though the temperature is set here on the basis of the temperature of environment in which the stencil printer is installed, the operator may measure the temperature inside or around the printing drum 1, and input a temperature on the basis of the measured temperature.

Figure 10:
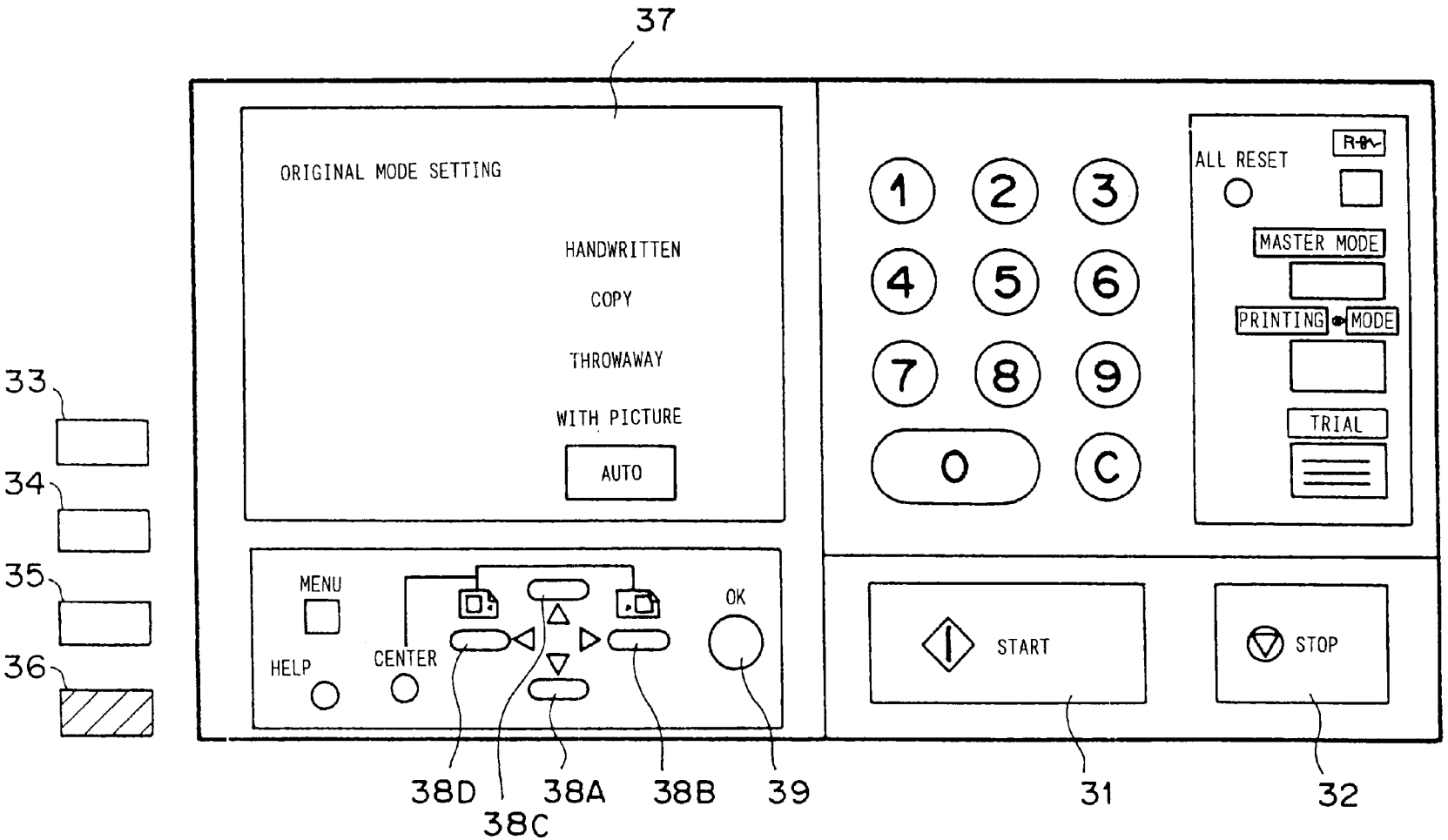
FIG. 10 is a view showing the state of the display on the control panel when setting the mode of the original.

When the original mode setting switch 36 is depressed, an original mode setting frame shown in FIG. 10 appears on the LCD panel 37. One of "auto", "handwritten", "copy", "throwaway" and "with picture" is selected by operating the selection keys 38A to 38D, and the selected original mode is reversed. Then by depressing the verification key 39, the selected original mode is verified and the initial frame shown in FIG. 6 is displayed again.

The in-drum mechanism 40 comprises a temperature sensor 41 which detects the temperature of environment in which the stencil printer is installed, or the temperature inside or around the printing drum 1, and inputs a detecting signal into the third A/D converter 26, an ink viscosity setting switch 42 for setting the viscosity of ink, an internal press roll gap setting switch 43, a position sensor 14 which detects the initial position of the internal press roll 4, an ink sensor 44 which detects the size of an ink swirl on the internal press roll 4, said pulse motor 10, an ink supply motor 45 which drives the ink pump (not shown) to supply ink to the internal press roll 4, and a cumulative number counter 46 which counts the cumulative number of times of printing. The ink viscosity setting switch 42 and the internal press roll gap setting switch 43 are provided on a unit for incorporating the printing drum 1 in the stencil printer and are for setting the viscosity of ink and the width of the gap between the internal press roll 4 and the doctor roll 18 as those on the control panel 30.

The drive section 50 comprises a pulse motor drive circuit 51 for driving the pulse motor 10, an ink supply motor drive circuit 52 for driving the ink supply motor 45, and an ink supply motor current detecting circuit 53 which detects the electric current supplied to the ink supply motor 45 and inputs a detecting signal representing the electric current supplied to the ink supply motor 45 into the second A/D converter 25.

The printing drum drive section 60 comprises a printing drum motor 61 which drives the printing drum 1, a printing drum motor drive circuit 62 for driving the printing drum motor 61, and a printing drum motor current detecting circuit 63 which detects the electric current supplied to the printing drum motor 61 and inputs a detecting signal representing the electric current supplied to the printing drum motor 61 into the first A/D converter 24.

Figure 11:
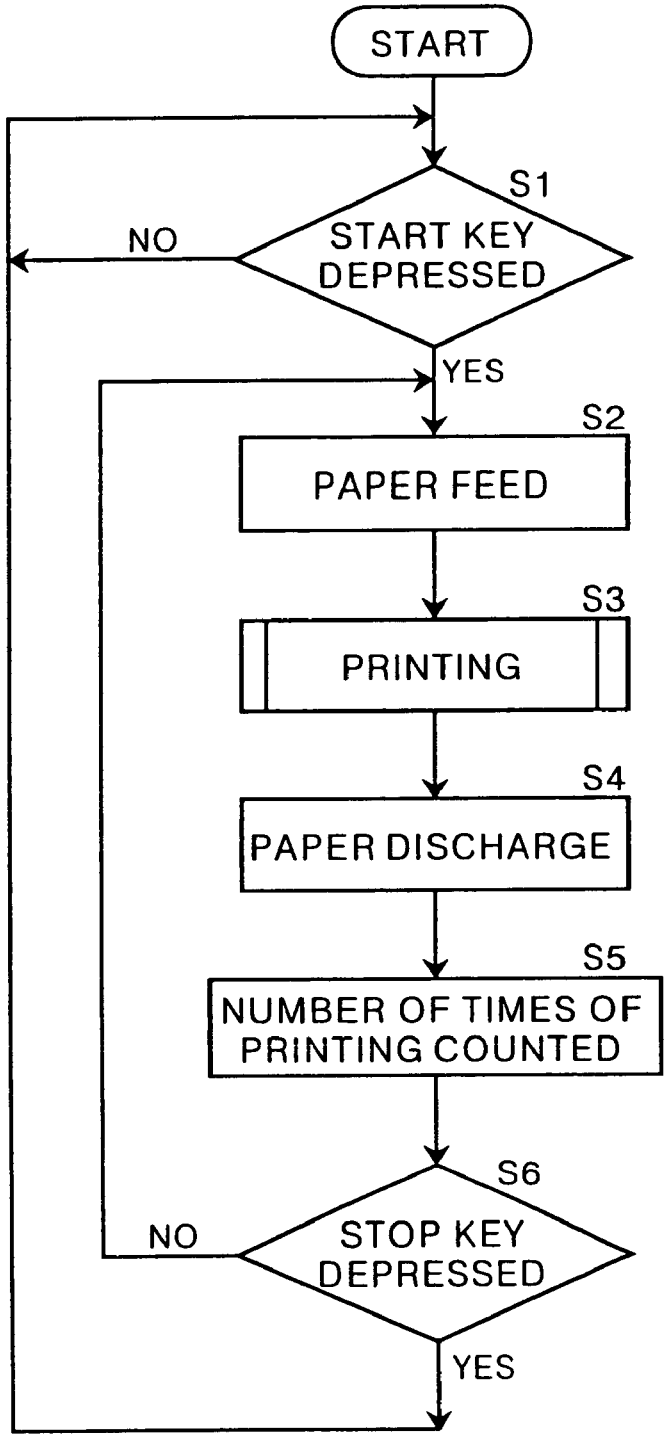
FIG. 11 is a flow chart for illustrating general operation of the stencil printer of the embodiment.

Operation of the stencil printer of this embodiment will be described, hereinbelow. FIG. 11 is a flow chart for illustrating general operation of the stencil printer of this embodiment. When the start key 31 is depressed, feeding of printing paper is started, and then a printing operation and a paper discharge operation are effected. (steps S1 to S4) Then the cumulative number of times of printing is counted (step S5) Steps S2 to S5 are repeated until the stop key 32 is depressed. (step S6) When the stop key 32 is depressed, the system waits for the start key 31 to be depressed. (step S1)

Figure 12:
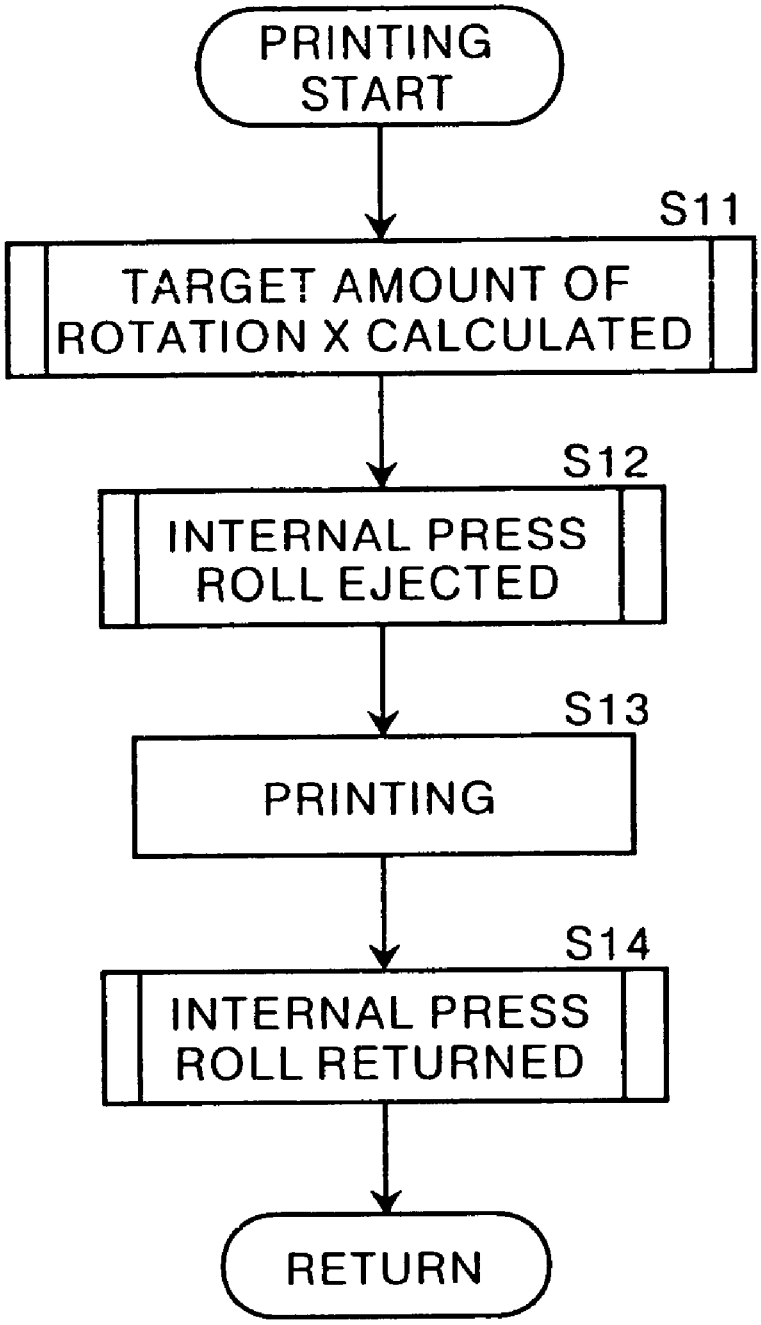
FIG. 12 is a flow chart for illustrating printing operation of the stencil printer.

As shown in FIG. 12, in the printing operation, the target amount of rotation X by which the pulse motor 10 is to be rotated is first calculated. (step S11) Then the pulse motor 10 is driven on the basis of the calculated target amount of rotation X and the internal press roll 4 is ejected (step S12) and printing is done with the amount of ejection of the internal press roll 4 corresponding to the calculated amount of rotation X of the pulse motor 10 (step S13). After printing is finished, the internal press roll 4 is returned to the initial position. (step S14)

Figure 13:
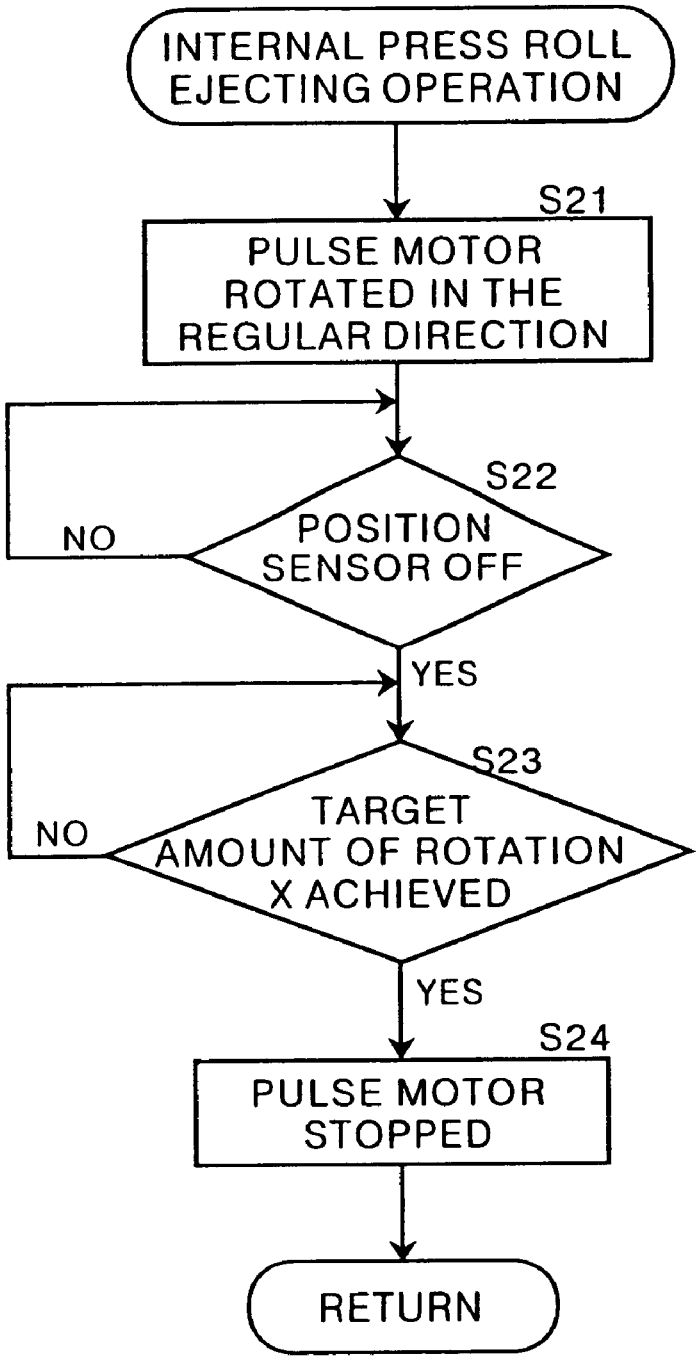
FIG. 13 is a flow chart for illustrating internal press roll ejecting operation of the stencil printer.
Figure 14:
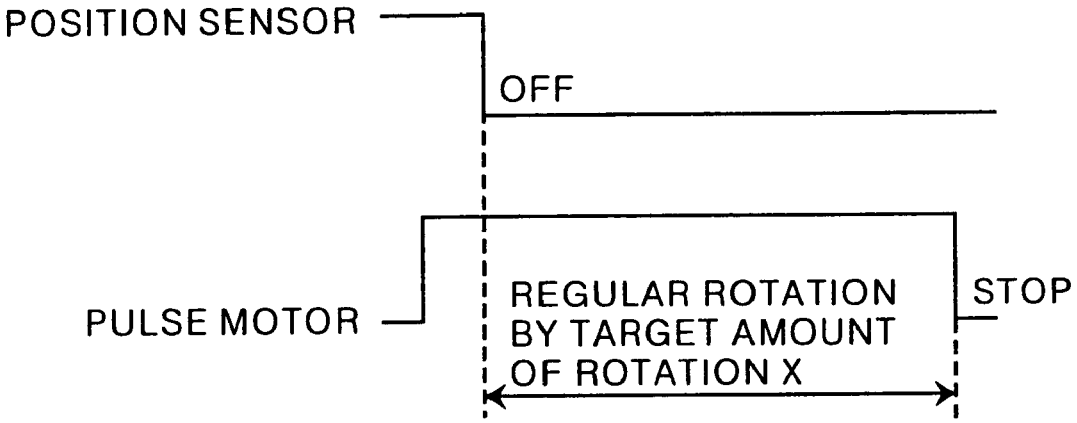
FIG. 14 is a time chart showing the internal press roll ejecting operation.

As shown in FIG. 13, in the internal press roll ejecting operation, the pulse motor 10 is rotated in the regular direction, i.e., in the direction in which the internal press roll 4 is pushed toward the back press roll 3 to press the peripheral wall of the printing drum 1 against the back press roll 3. (step S21) The pulse motor 10 is kept driven until the position sensor 14 is turned off (the light shielding plate 13 is moved from the position where it opposed to the position sensor 14) and the rotation of the pulse motor 10 reaches the target amount of rotation X calculated in step S11. (steps S23 to S24) FIG. 14 is a time chart showing this internal press roll ejecting operation.

Figure 15:
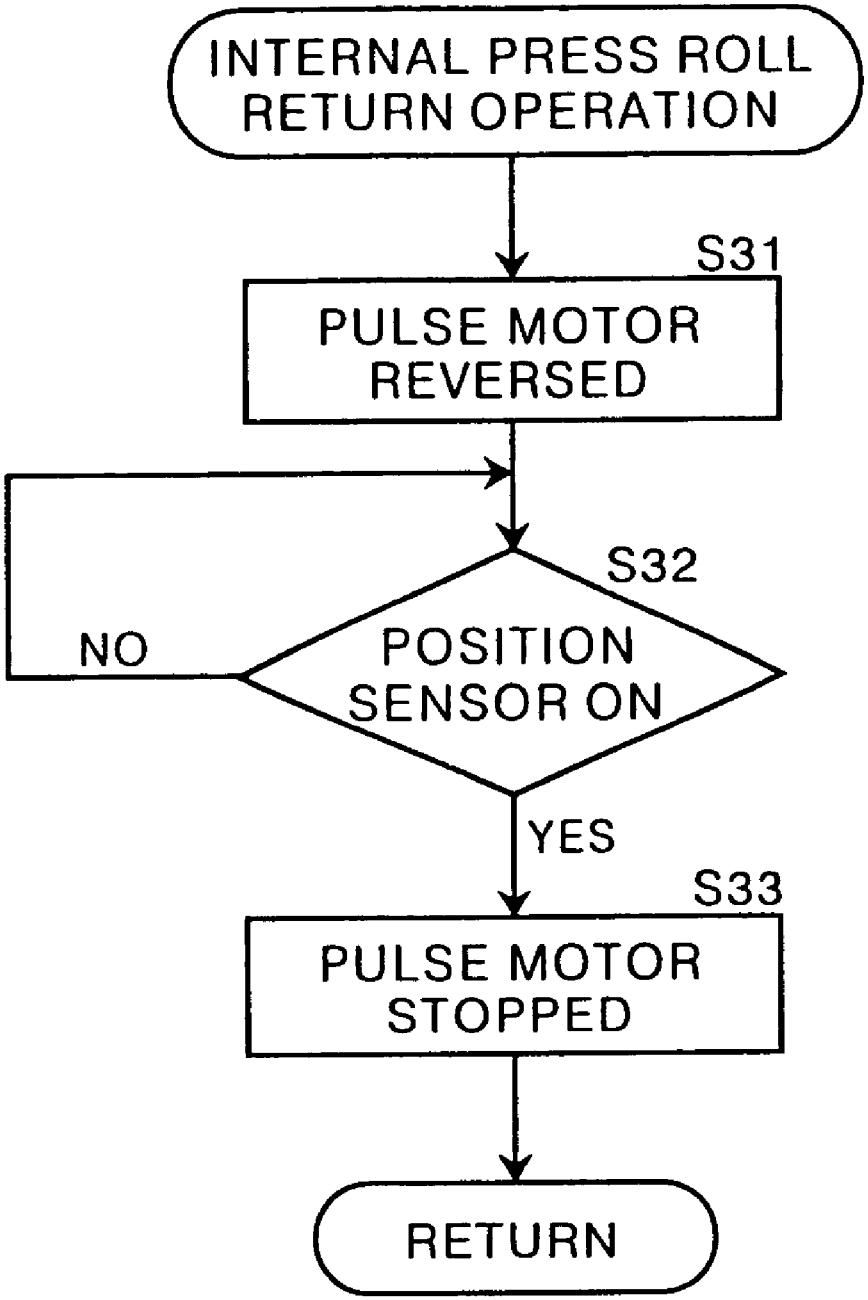
FIG. 15 is a flow chart for illustrating the internal press roll return operation.
Figure 16:
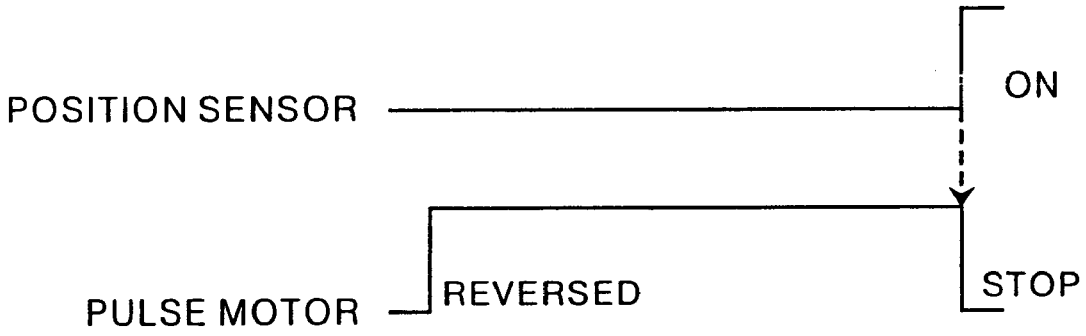
FIG. 16 is a time chart showing the internal press roll return operation.

FIG. 15 is a flow chart for illustrating the internal press roll return operation. As shown in FIG. 15, in the internal press roll return operation, the pulse motor 10 is reversed to move the internal press roll 4 away from the back press roll 3 until the position sensor 14 is turned on, and then the pulse motor 10 is stopped. (steps S31 to S33) FIG. 16 is a time chart showing this internal press roll return operation.

Figure 17:
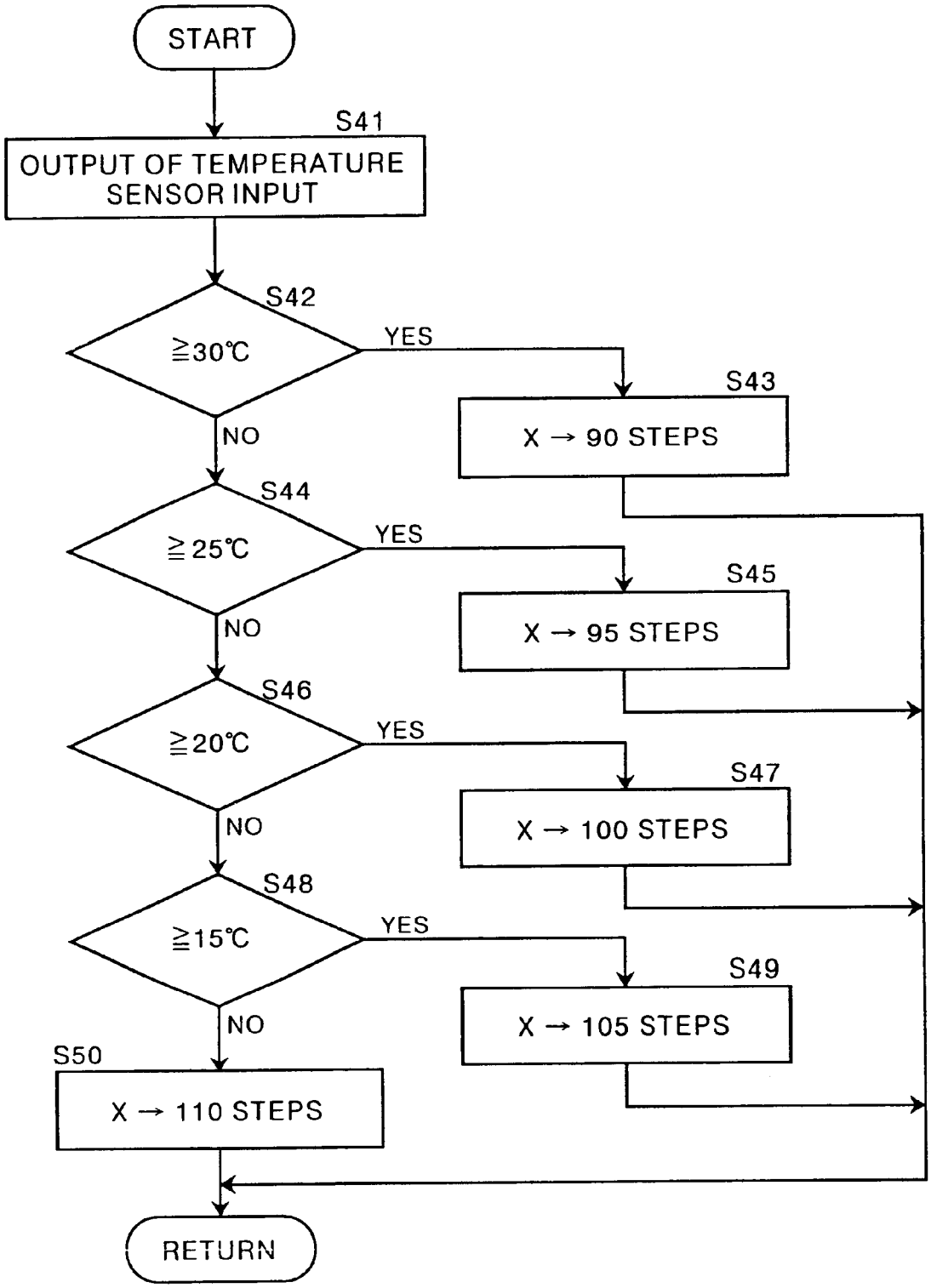
FIG. 17 is a flow chart for calculating the target amount of rotation of the pulse motor on the basis of the temperature of the ink.

Calculation of the target amount of rotation X of the pulse motor 10 will be described, hereinbelow. FIG. 17 is a flow chart for calculating the target amount of rotation X of the pulse motor 10 on the basis of the temperature of the ink. That is, when the temperature inside or around the printing drum 1 or the temperature of environment in which the stencil printer is installed, and the temperature of ink is low, the viscosity of ink becomes high and the printing density for a given printing pressure becomes low. To the contrast, when the temperature of ink is high, the viscosity of ink becomes low and the printing density for a given printing pressure becomes high. Accordingly, in this particular embodiment, the printing pressure is changed by changing the amount of ejection of the internal press roll 4 according to the temperature inside or around the printing drum 1 or the temperature of environment in which the stencil printer is installed detected by the temperature sensor 41 so that the printing density is kept constant irrespective of the temperature of the ink.

Figure 18:
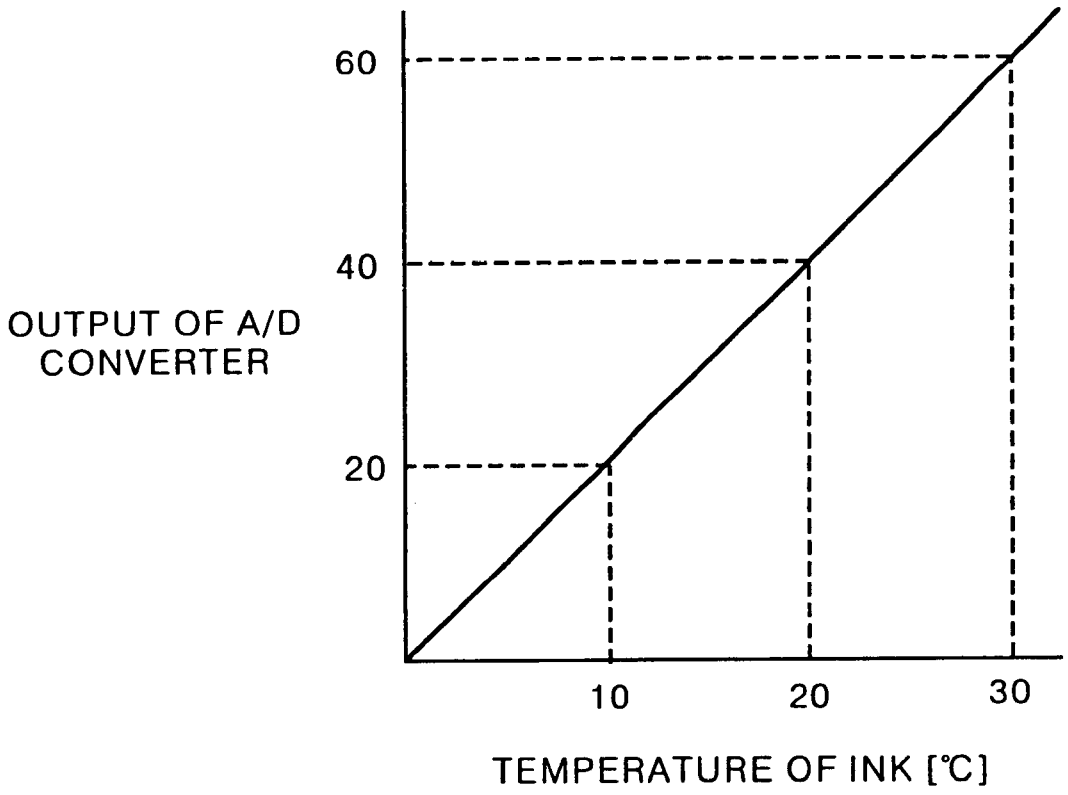
FIG. 18 is a graph showing the relation between the temperature of the ink and the output of the third A/D converter.

As shown in FIG. 17, the detecting signal of the temperature sensor 41 is input into the CPU 21 through the third A/D converter 26. (step S41) As shown in FIG. 18, the output of the third A/D converter 26 is proportional to the temperature of the ink. When the temperature of the ink is not lower than 30° C. (output of the third A/D converter 26 is not smaller than 60), the target amount of rotation X is set to 90 steps. (steps S42 and S43) When the temperature of the ink is not lower than 25° C. and lower than 30° C. (output of the third A/D converter 26 is not smaller than 50 and smaller than 60), the target amount of rotation X is set to 95 steps. (steps S42, S44 and S45) When the temperature of the ink is not lower than 20° C. and lower than 25° C. (output of the third A/D converter 26 is not smaller than 40 and smaller than 50), the target amount of rotation X is set to 100 steps. (steps S42, S44, S46 and S47) When the temperature of the ink is not lower than 15° C. and lower than 20° C. (output of the third A/D converter 26 is not smaller than 30 and smaller than 40), the target amount of rotation X is set to 105 steps. (steps S42, S44, S46, S48 and S49) When the temperature of the ink is lower than 15° C. (step S48: NO), the target amount of rotation X is set to 110 steps (step S50).

Figure 19:
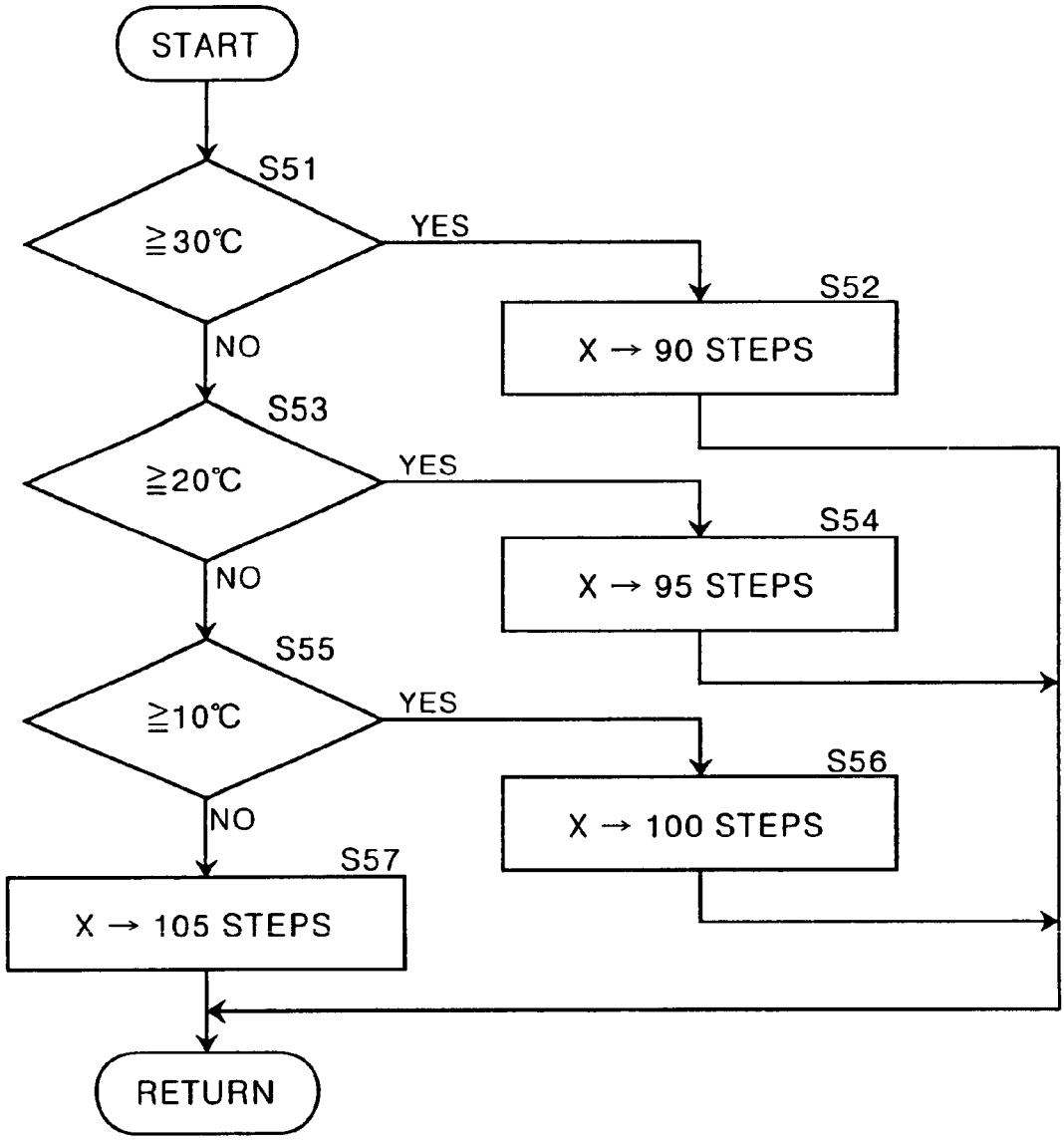
FIG. 19 is a flow chart for calculating the target amount of rotation of the pulse motor on the basis of the temperature input through the control panel.

FIG. 19 is a flow chart for calculating the target amount of rotation X of the pulse motor 10 on the basis of the temperature input through the control panel 30. As shown in FIG. 19, when the temperature set in the temperature setting frame shown in FIG. 9 is not lower than 30° C., the target amount of rotation X is set to 90 steps. (steps S51 and S52) When the temperature set in the temperature setting frame is not lower than 20° C. and lower than 30° C., the target amount of rotation X is set to 95 steps. (steps S51, S53 and S54) When the temperature set in the temperature setting frame is not lower than 10° C. and lower than 20° C., the target amount of rotation X is set to 100 steps. (steps S51, S53, S55 and S56) When the temperature set in the temperature setting frame is lower than 10° C. (step S55: NO), the target amount of rotation X is set to 105 steps (step S57).

By increasing the target amount of rotation X of the pulse motor 10 as the temperature of the ink lowers, the amount of ejection of the internal press roll 4 is increased and the printing pressure increases. Accordingly, the printing pressure is changed according to the viscosity of the ink, which depends upon the temperature of the ink, so that the printing density is kept constant irrespective of the temperature of the ink.

Though, in this embodiment, the temperature of the ink is detected through the temperature inside or around the printing drum 1 or the temperature of environment in which the stencil printer is installed, the temperature of the ink may be directly detected.

Figure 20:
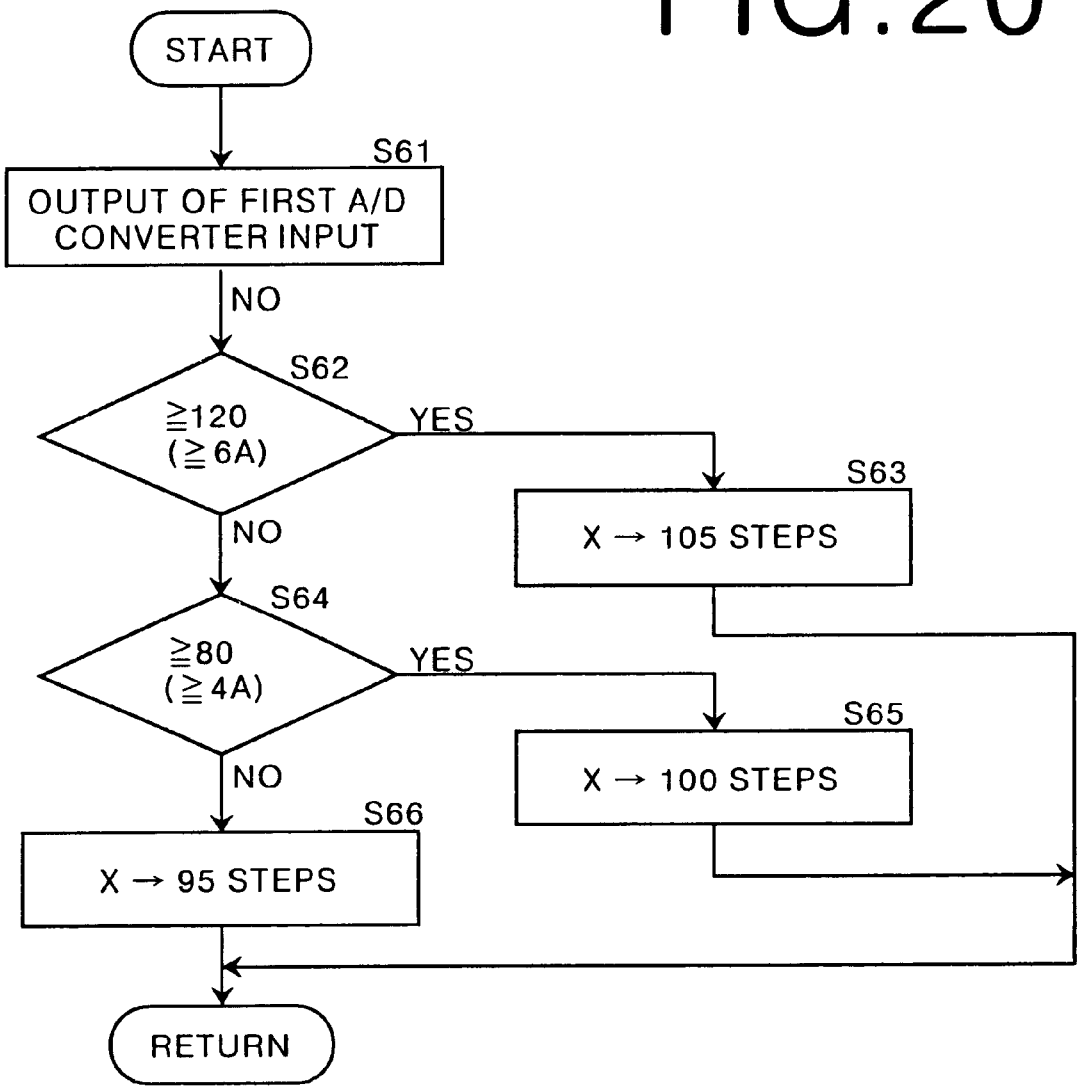
FIG. 20 is a flow chart for calculating the target amount of rotation of the pulse motor on the basis of the viscosity of the ink.

FIG. 20 is a flow chart for calculating the target amount of rotation X of the pulse motor 10 on the basis of the viscosity of the ink. That is, as the viscosity of ink becomes higher (the ink is harder), it becomes more difficult to eject the ink through the printing drum 1 and the printing density for a given printing pressure becomes lower. To the contrast, as the viscosity of ink becomes lower, it becomes easier to eject the ink through the printing drum 1 and the printing density for a given printing pressure becomes higher. Accordingly, the printing pressure is changed by changing the amount of ejection of the internal press roll 4 according to the viscosity of the ink so that the printing density is kept constant irrespective of the viscosity of the ink. The viscosity of the ink is detected here by way of the amount of electric current supplied to the printing drum motor 61. That is, the ink agitator rod 17 agitates the ink swirl under the driving force of the printing drum motor 61 and accordingly, the driving force required to drive the ink agitator rod 17 changes with the viscosity of the ink. Accordingly, the viscosity of the ink can be estimated on the basis of the amount of electric current supplied to the printing drum motor 61 when agitating the ink, which may be considered to be in proportional to the torque on the ink agitator rod 17.

Figure 21:
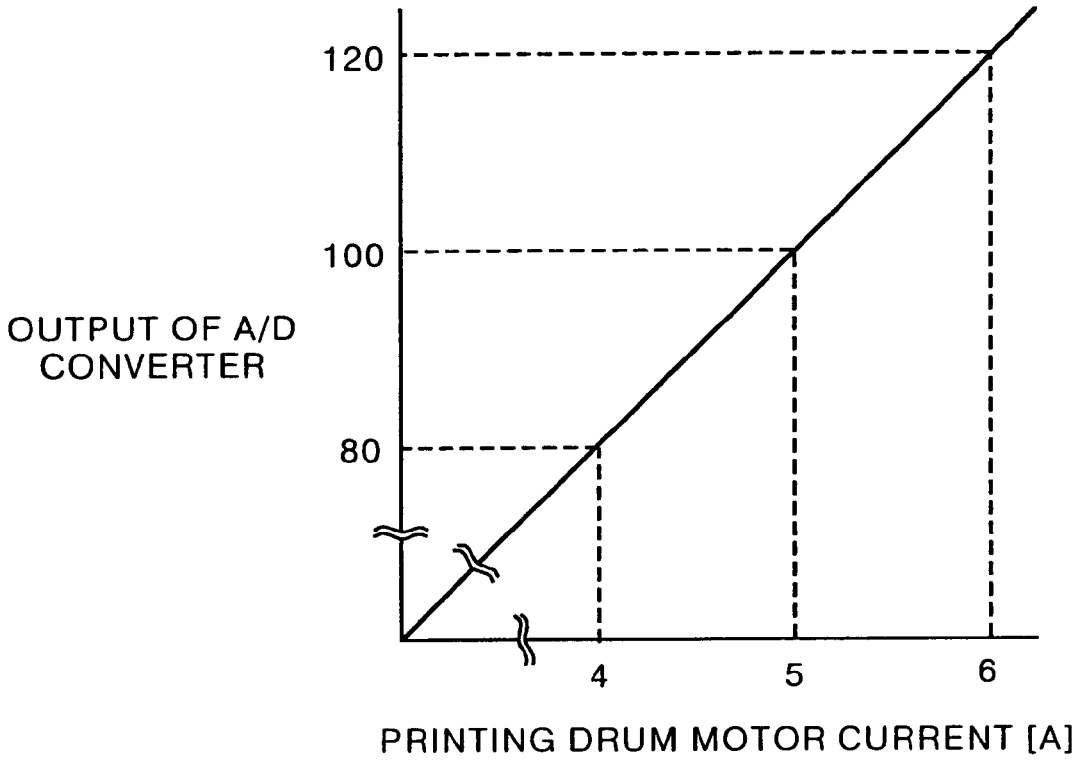
FIG. 21 is a graph showing the relation between the printing drum motor current and the output of the first A/D converter.

As shown in FIG. 20, the detecting signal of the printing drum motor current detecting circuit 63 is input into the CPU 21 through the first A/D converter 24. (step S61) As shown in FIG. 21, the output of the first A/D converter 24 is proportional to the amount of electric current supplied to the printing drum motor 61. When the output of the first A/D converter 24 is not smaller than 120 (the amount of electric current supplied to the printing drum motor 61 is not smaller than 6A), the target amount of rotation X is set to 105 steps. (steps S62 and S63) When the output of the first A/D converter 24 is not smaller than 80 and smaller than 120 (the amount of electric current supplied to the printing drum motor 61 is not smaller than 4A and smaller than 6A), the target amount of rotation X is set to 100 steps. (steps S62, S64 and S65) When the output of the first A/D converter 24 is smaller than 80 (the amount of electric current supplied to the printing drum motor 61 is smaller than 4A) (step S64: NO), the target amount of rotation X is set to 95 steps (step S66).

Figure 22:
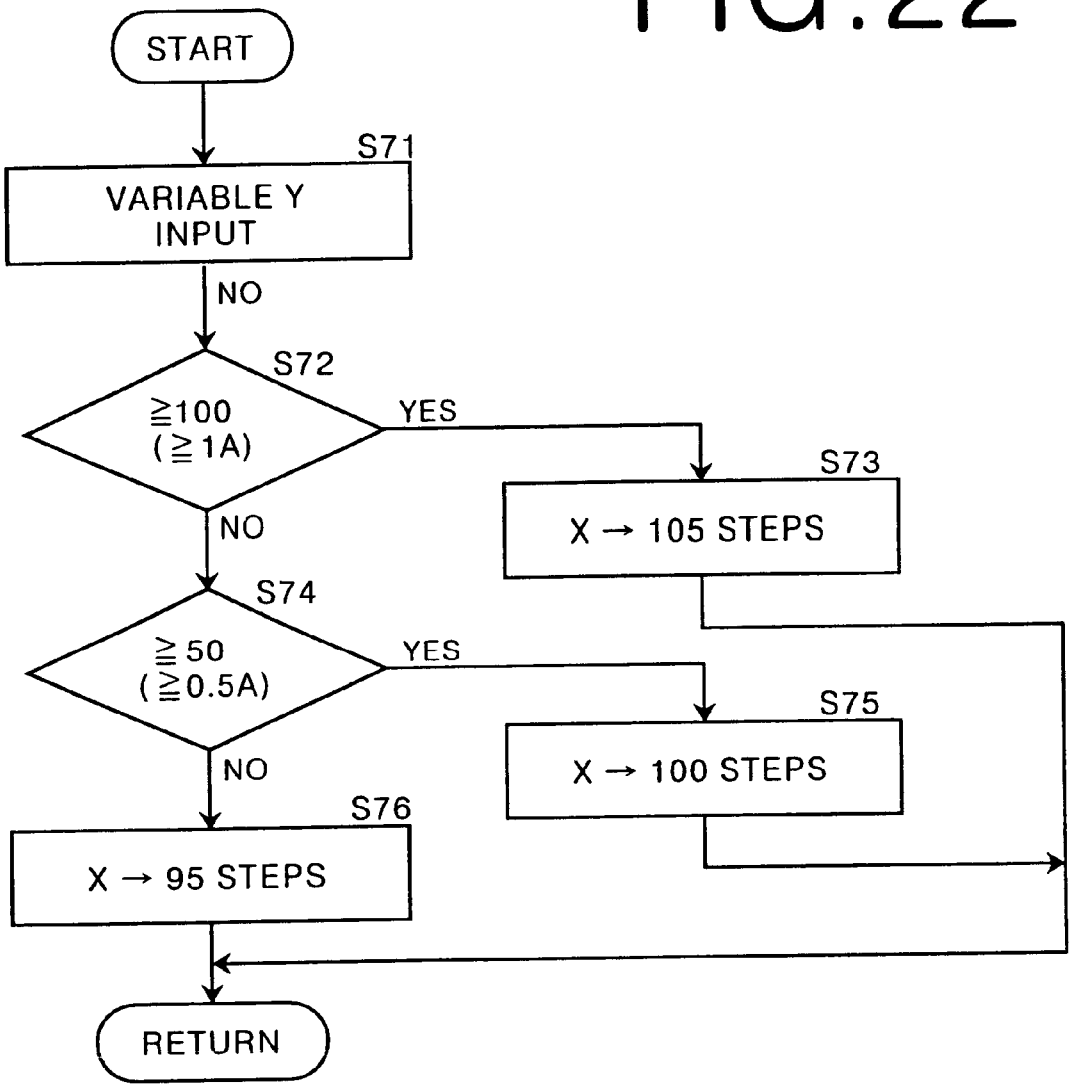
FIG. 22 is a flow chart for calculating the target amount of rotation of the pulse motor on the basis of the viscosity of the ink as detected on the basis of the amount of electric current supplied to the ink supply motor.
Figure 23:
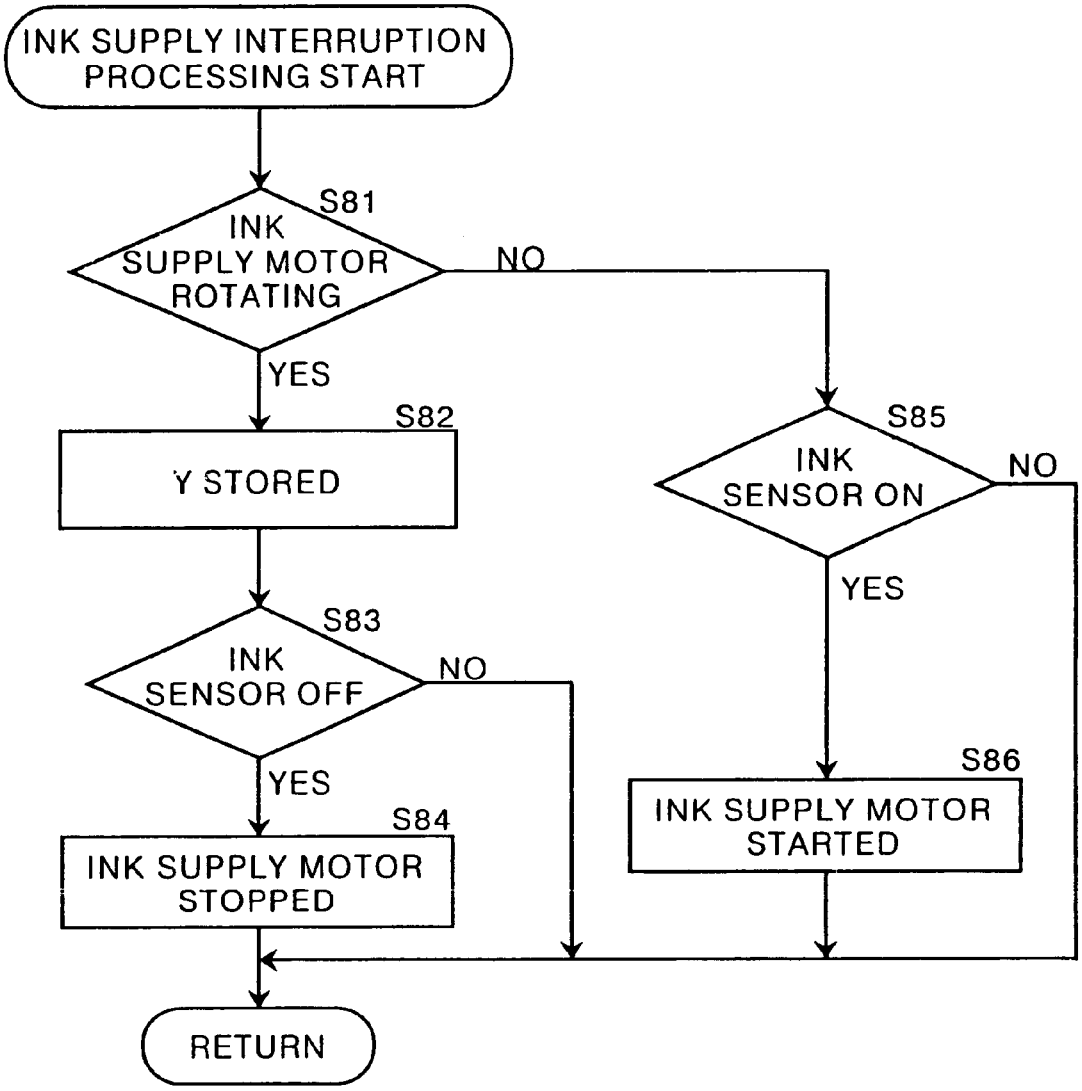
FIG. 23 is a flow chart for illustrating the ink supply interruption processing.
Figure 24:
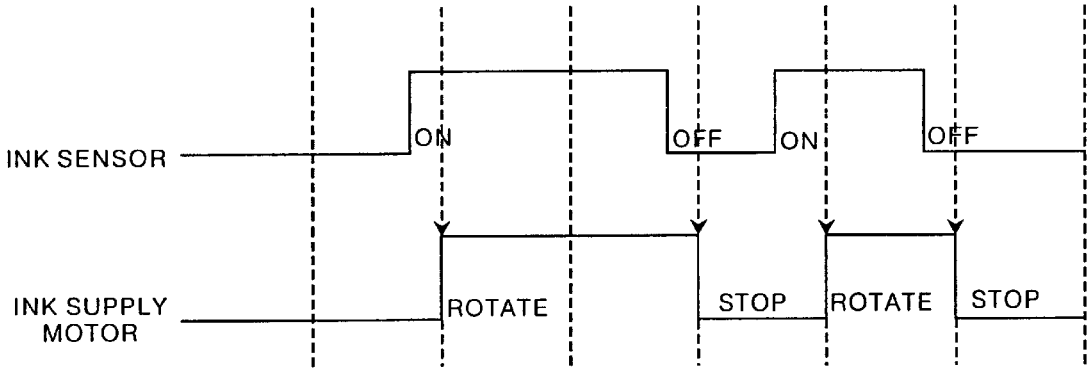
FIG. 24 is a time chart for the ink supply interruption processing.
Figure 25:
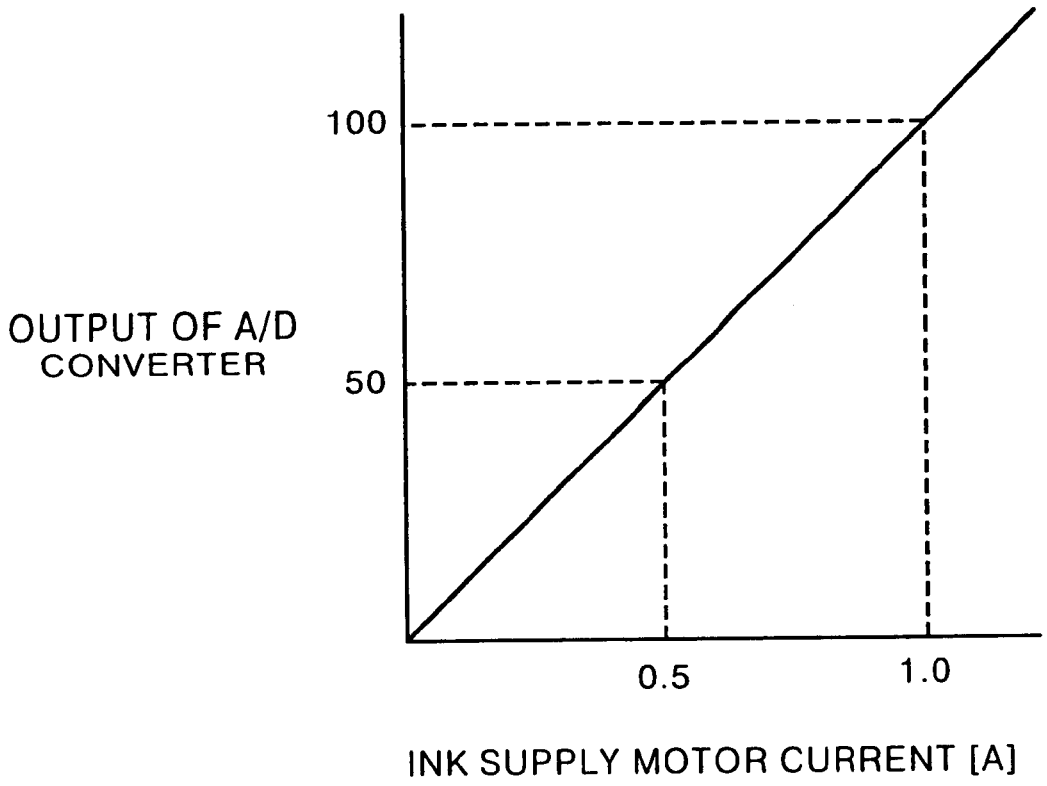
FIG. 25 is a graph showing the relation between the ink supply motor current and the output of the second A/D converter.

FIG. 22 is a flow chart for calculating the target amount of rotation X of the pulse motor 10 on the basis of the viscosity of the ink as detected on the basis of the amount of electric current supplied to the ink supply motor 45. In FIG. 22, a variable Y which has been stored in an ink supply interruption processing is input into the CPU 21. (step S71) FIG. 23 is a flow chart for illustrating the ink supply interruption processing. As shown in FIG. 23, in the ink supply interruption processing, it is determined whether the ink supply motor 45 is rotating. (step S81) When it is determined that the ink supply motor 45 is rotating, the detecting signal of the ink supply motor current detecting circuit 53 is input into the CPU 21 through the second A/D converter 25 and the value of the output of the second A/D converter 25 is stored in the RAM 23 as the variable Y. (step S82) As shown in FIG. 25, the output of the second A/D converter 25 is proportional to the ink supply motor current. Further, it is determined whether the ink sensor 44 is off, that is, whether the ink sensor 44 has detected ink. (step S83) When it is determined that the ink sensor 44 is off, the ink supply motor 45 is turned off (step S84) and the processing returns. When it is determined that the ink sensor 44 is not off, the processing directly returns. When it is determined in step S81 that the ink supply motor 45 is not rotating, it is determined in step S85 whether the output of the ink sensor 44 is on (the output of the ink sensor 44 is turned on when the ink sensor 44 does not detect ink). When it is determined that the output of the ink sensor 44 is on, the processing returns after the ink supply motor 45 started (step S86), and otherwise the processing directly returns. FIG. 24 is a time chart for the ink supply interruption processing.

Again in FIG. 22, when the value of the variable Y is not smaller than 100 (the ink supply motor current is not smaller than 1A), the target amount of rotation X is set to 105 steps. (steps S72 and S73) When the value of the variable Y is not smaller than 50 and smaller than 100 (the ink supply motor current is not smaller than 0.5A and smaller than 1A), the target amount of rotation X is set to 100 steps. (steps S72, S74 and S75) When the value of the variable Y is smaller than 50 (the ink supply motor current is smaller than 0.5A) (step S74: NO), the target amount of rotation X is set to 95 steps (step S76).

Figure 26:
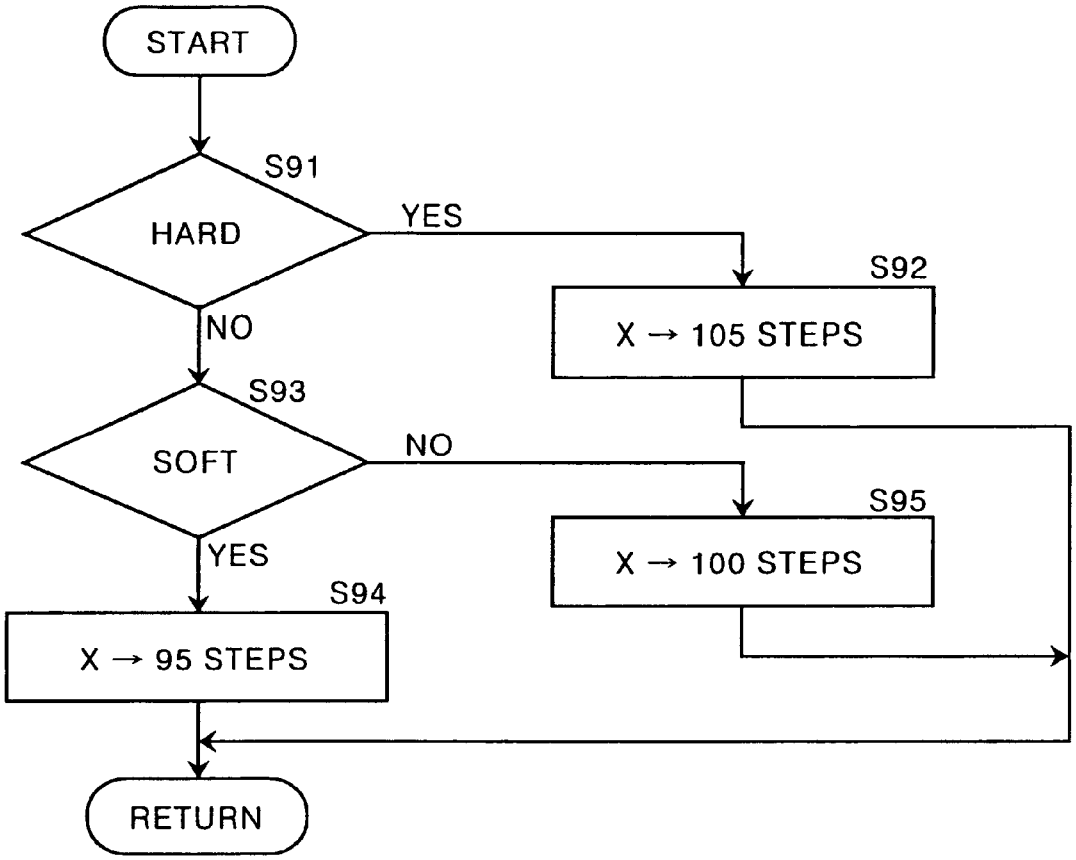
FIG. 26 is a flow chart for calculating the target amount of rotation of the pulse motor on the basis of the viscosity of ink input through the control panel.

FIG. 26 is a flow chart for calculating the target amount of rotation X of the pulse motor 10 on the basis of the viscosity of ink input through the control panel 30. As shown in FIG. 26, when the viscosity of ink set in the ink viscosity setting frame shown in FIG. 7 is "hard", the target amount of rotation X is set to 105 steps. (steps S91 and S92) When the viscosity of ink set in the ink viscosity setting frame is "soft", the target amount of rotation X is set to 95 steps. (steps S91, S93 and S94) When the viscosity of ink set in the ink viscosity setting frame is "normal", the target amount of rotation X is set to 100 steps. (steps S91, S93 and S95)

By increasing the target amount of rotation X of the pulse motor 10 as the viscosity of ink increases, the amount of ejection of the internal press roll 4 is increased and the printing pressure increases. Accordingly, the printing pressure is changed according to the viscosity of ink so that the printing density is kept constant irrespective of the viscosity of ink.

Figure 27:
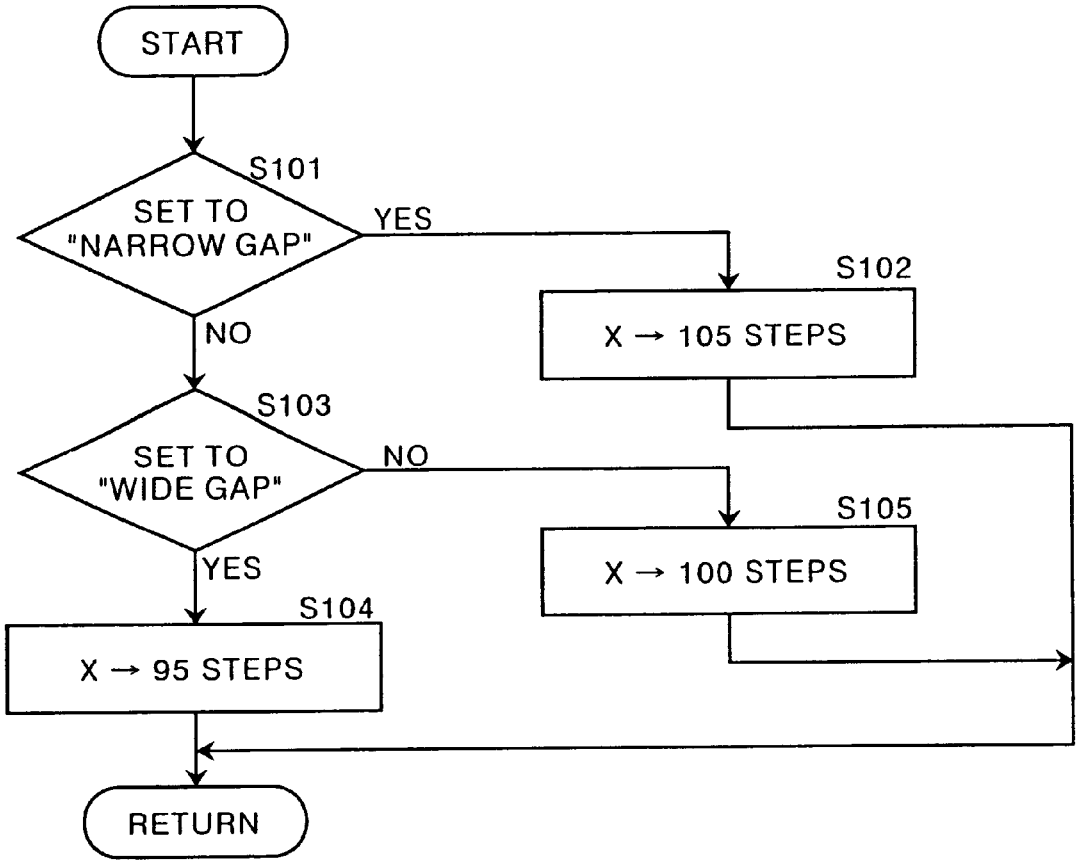
FIG. 27 is a flow chart for calculating the target amount of rotation of the pulse motor on the basis of the gap between the internal press roll and the doctor roll set by the internal press roll gap setting switch.

FIG. 27 is a flow chart for calculating the target amount of rotation X of the pulse motor 10 on the basis of the gap between the internal press roll 4 and the doctor roll 18 set by the internal press roll gap setting switch 43. Since the internal press roll 4 is of an elastic material such as rubber, the surface of the internal press roll 4 wears and the gap between the internal press roll 4 and the doctor roll 18 is increased by repeated printing operations. When the gap between the internal press roll 4 and the doctor roll 18 is widened, an excessive amount of ink is deposited on the internal press roll 4 and the printing density becomes higher. In the processing shown in FIG. 7, the target amount of rotation X of the pulse motor 10 is calculated so that a desired printing density can be obtained irrespective of the amount of wear of the internal press roll 4.

As shown in FIG. 27, when the internal press roll gap setting switch 43 is set to "narrow gap", which represents that the wear of the internal press roll 4 is little and the gap between the internal press roll 4 and the doctor roll 18 is narrow, the target amount of rotation X is set to 105 steps. (steps S101 and S102) When the internal press roll gap setting switch 43 is set to "wide gap", the target amount of rotation X is set to 95 steps. (steps S101, S103 and S104) When the internal press roll gap setting switch 43 is set to "normal gap", the target amount of rotation X is set to 100 steps. (steps S101, S103 and S105) The target amount of rotation X may be calculated on the basis of the gap set in the internal press roll gap setting frame shown in FIG. 8.

Figure 28:
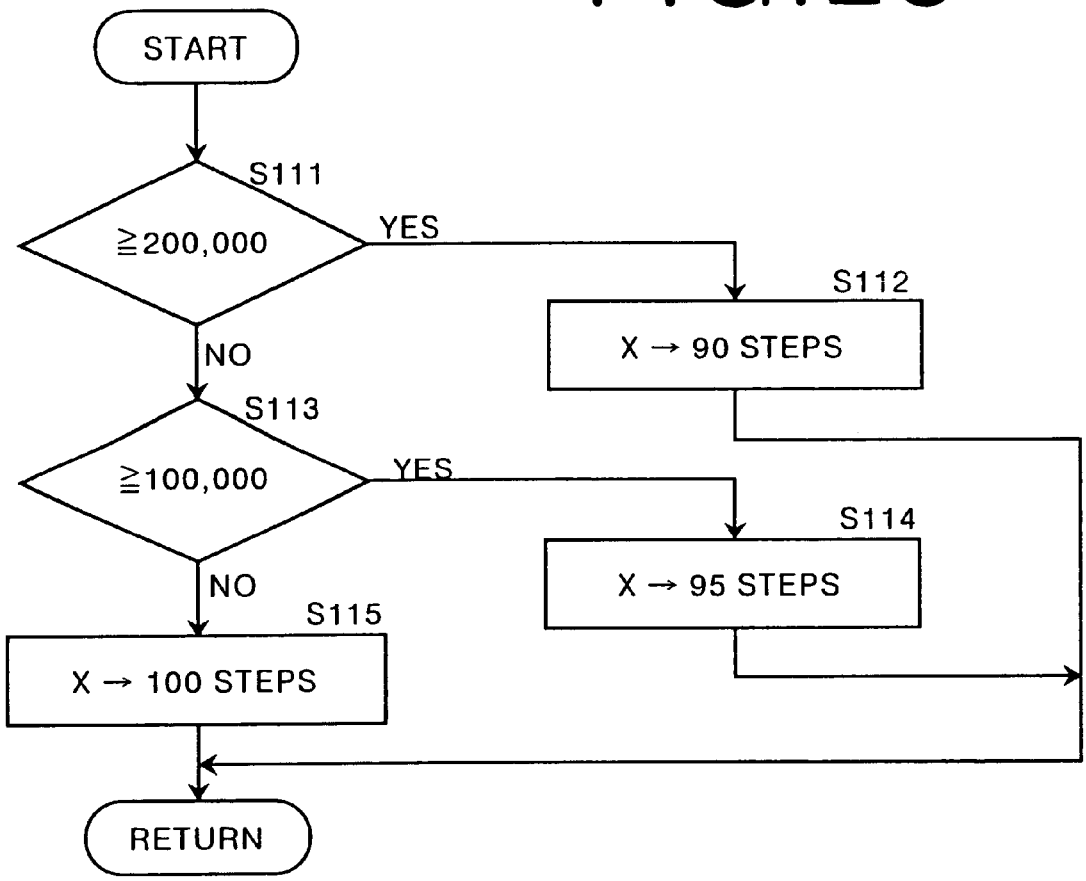
FIG. 28 is a flow chart for calculating the target amount of rotation of the pulse motor on the basis of the gap between the internal press roll and the doctor roll estimated on the basis of the cumulative number of times of printing.

FIG. 28 is a flow chart for calculating the target amount of rotation X of the pulse motor 10 on the basis of the gap between the internal press roll 4 and the doctor roll 18 estimated on the basis of the cumulative number of times of printing counted by the cumulative number counter 46. As shown in FIG. 28, when the count of the cumulative number counter 46 is not smaller than 200,000, which represents that the wear of the internal press roll 4 is large and the gap between the internal press roll 4 and the doctor roll 18 is wide, the target amount of rotation X is set to 90 steps. (steps S111 and S112) When the count of the cumulative number counter 46 is not smaller than 100,000 and smaller than 200,000, which represents that the wear of the internal press roll 4 is relatively large and the gap between the internal press roll 4 and the doctor roll 18 is relatively wide, the target amount of rotation X is set to 95 steps. (steps S111, S113 and S114) When the count of the cumulative number counter 46 is smaller than 100,000, which represents that the wear of the internal press roll 4 is little and the gap between the internal press roll 4 and the doctor roll 18 is narrow, the target amount of rotation X is set to 100 steps. (steps S111, S113 and S115)

By thus reducing the target amount of rotation X of the pulse motor 10 as the gap between the internal press roll 4 and the doctor roll 18 is widened, the amount of ejection of the internal press roll 4 is reduced and the printing pressure is lowered. As a result, the printing density is kept constant irrespective of the amount of wear of the internal press roll 4 or the width of the gap between the internal press roll 4 and the doctor roll 18.

Figure 29:
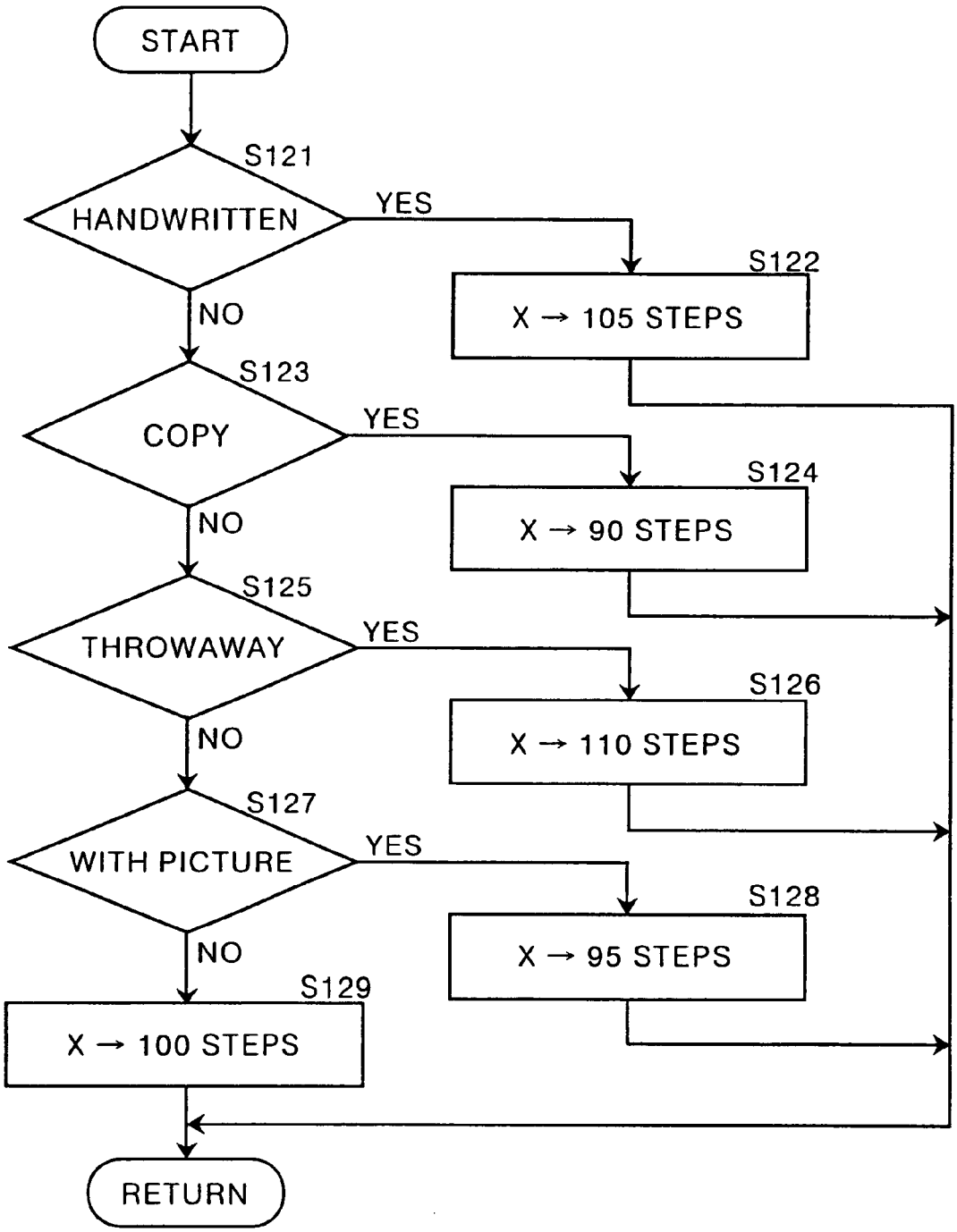
FIG. 29 is a flow chart for calculating the target amount of rotation of the pulse motor according to the original mode.

FIG. 29 is a flow chart for calculating the target amount of rotation X of the pulse motor 10 according to the original mode. As the original for printing, various types of originals such as a handwritten original, a copied original, an original for throwaway and the like are used, and a proper printing density differs according to the type of the original. In the processing shown in FIG. 29, the target amount of rotation X of the pulse motor 10 is calculated so that a proper printing density id obtained irrespective of the type of the original or the original mode.

As shown in FIG. 29, when the original mode set in the original mode setting frame shown in FIG. 10 is "handwritten", the target amount of rotation X is set to 105 steps for the purpose of increasing the printing density. (steps S121 and S122) When the original mode set in the original mode setting frame shown in FIG. 10 is "copy", the target amount of rotation X is set to 90 steps for the purpose of preventing saturation in detail. (steps S123 and S124) When the original mode set in the original mode setting frame shown in FIG. 10 is "throwaway", the target amount of rotation X is set to 110 steps for the purpose of preventing skip in a solid part (steps S125 and S126) When the original mode set in the original mode setting frame shown in FIG. 10 is "with picture", the target amount of rotation X is set to 95 steps for the purpose of properly expressing the gradation. (steps S127 and S128) Otherwise, the target amount of rotation X is set to 100 steps. (step S129)

By setting the target amount of rotation X, a proper printing density can be obtained according to type of the original.

The type of the original may be automatically detected in the manner disclosed, for instance, in Japanese Unexamined Patent Publication No. 7(1995)-322061 and the target amount of rotation X may be calculated on the basis of the type of the original.

Further it is possible to make it feasible to select an economy mode in the original mode setting frame shown in FIG. 10 and to reduce the target amount of rotation X in order to reduce consumption of ink when the economy mode is selected.

Though, in the embodiment described above, the amount of rotation of the pulse motor 10, that is, the amount of ejection of the internal press roll, is changed according to the viscosity of ink, the temperature of ink, the gap between the internal press roll 4 and the doctor roll 18 or the original mode, the amount of rotation of the pulse motor 10 may be changed according to the printing speed. That is, the printing paper is nipped between the internal press roll 4 and the back press roll 3 and as the printing speed increases, the time for which the printing paper is nipped between the internal press roll 4 and the back press roll 3 is shortened and the amount of ink transferred to the printing paper is reduced. That is, the printing density fluctuates with the printing speed. By changing the amount of ejection of the internal press roll 4 according to the printing speed, the printing density can be stabilized irrespective of the printing speed.

Specifically, when the radius of the printing drum 1 is represented by R, the printing speed is changed in two speeds, one corresponding to 80 rpm of the printing drum 1 and the other corresponding to 120 rpm of the printing drum 1, and the nipping length of the printing paper (by which the printing paper is nipped between the internal press roll 4 and the back press roll 3 in the direction of conveyance of the printing paper) is 10 mm, the conveying speed of the printing paper is $2.667\pi$ Rmm/sec in the case of the printing speed of 80 rpm and $4.000\pi$ Rmm/sec in the case of the printing speed of 120 rpm. In this case, the nipping time is 10 mm/$2.667\pi$ Rmm/sec=$3.75\pi$ Rsec and 10 mm/$4.000\pi$ Rmm/sec=2.50π Rsec. In order to substantially equalize the nipping time, it is necessary to reduce the nipping length when the printing speed is 80 rpm as compared with when the printing speed is 120 rpm. The nipping length can be reduced by reducing the amount of ejection of the internal press roll 4 or the amount of rotation of the pulse motor 10. That is, by reducing the amount of ejection of the internal press roll 4 so that the nipping length becomes 6.667 mm when the printing speed is 80 rpm, the nipping time can be substantially equalized to that when the printing speed is 120 rpm. That is, 6.667 mm/2.667π Rmm/sec=2.50π Rsec. By thus changing the amount of ejection of the internal press roll 4 according to the printing speed, the amount of ink transferred to the printing paper can be substantially constant and the printing density can be substantially constant irrespective of the printing speed.

Though, in the embodiment described above, the amount of rotation of the pulse motor 10, that is, the amount of ejection of the internal press roll, is changed according to the viscosity of ink, the temperature of ink, the gap between the internal press roll 4 and the doctor roll 18 or the original mode, the amount of rotation of the pulse motor 10 may be changed to user liking. For example, by setting the amount of ejection of the internal press roll through the control panel 30 to the user liking, the printed image can be in a density to the user liking.

Further, since the amount of ejection of the internal press roll 4 can be differently set at the opposite ends of the internal press roll 4 in the particular embodiment described above, the printing pressure can be easily made uniform even if dimensional accuracy and assembling accuracy of the components of the stencil printer are not so high. Further printing can be done in different densities in the direction of width of the printing paper.

Further, though the amount of ejection of the internal press roll 4 can be differently set at the opposite ends of the internal press roll 4 in the particular embodiment described above, the system may be arranged so that the amount of ejection of the internal press roll 4 cannot be differently set at the opposite ends of the internal press roll 4.

Further, though, in the embodiment described above, the amount of ejection of the internal press roll 4 is changed by use of the pulse motor 10 and the eccentric cam 8, other various mechanism may be used.

In addition, all of the contents of Japanese Patent Application No. 11(1999)-218839 are incorporated into this specification by reference.

What is claimed is:

1. A stencil printer comprising: a printing drum which has an ink-permeable peripheral wall and is rotated about a predetermined axis of rotation with a stencil master wound around the peripheral wall, a back press roll which associates with the printing drum to nip and convey a printing paper, and an internal press roll which is provided in the printing drum to be movable back and forth toward and away from the back press roll and pushes the peripheral wall of the printing drum toward the back press roll, an internal press roll drive means which moves back and forth the internal press roll between a first position where the internal press roll is held away from the back press roll and a second position at a distance from the first position toward the back press roll and is able to freely change the distance between the axis of rotation of the printing drum and the second position, wherein said internal press roll drive means comprises a support member which supports opposite ends of the internal press roll and is rotateable about a predetermined axis of rotation, a cam member which is in abutment against the support member and is rotated relative to the printing drum and the support member to move up and down the support member, and a rotation control means which controls the amount of rotation of the cam member.

2. A stencil printer as defined in claim 1 in which the internal press roll drive means is provided with a means for moving opposite ends of the internal press roll independently of each other.

3. A stencil printer as defined in claim 1 in which the stencil printer further comprises a printing speed setting means for setting the printing speed and the internal press roll drive means changes the distance between the axis of rotation of the printing drum and the second position according to the printing speed set by the printing speed setting means.

4. A stencil printer as defined in claim 1 in which the stencil printer further comprises an ink temperature detecting means which detects the temperature of the ink and the internal press roll drive means changes the distance between the axis of rotation of the printing drum and the second position according to the temperature of the ink detected by the ink temperature detecting means.

5. A stencil printer as defined in claim 4 in which the ink temperature detecting means detects the temperature of the ink through the ambient temperature of the printing drum, the temperature inside the printing drum or the ambient temperature of the stencil printer.

6. A stencil printer as defined in claim 1 in which the stencil printer further comprises an ink temperature input means for manually inputting a temperature of the ink, and the internal press roll drive means changes the distance between the axis of rotation of the printing drum and the second position according to the temperature of the ink input through the ink temperature input means.

7. A stencil printer as defined in claim 6 in which the temperature of the ink is represented by the ambient temperature of the printing drum, the temperature inside the printing drum or the ambient temperature of the stencil printer.

8. A stencil printer as defined in claim 1 in which the stencil printer further comprises an ink viscosity detecting means which detects the viscosity of the ink and the internal press roll drive means changes the distance between the axis of rotation of the printing drum and the second position according to the viscosity of the ink detected by the ink viscosity detecting means.

9. A stencil printer as defined in claim 8 in which the ink viscosity detecting means detects the viscosity of the ink through the electric current supplied to the electric motor for driving the printing drum or to the electric motor for supplying the ink to the printing drum.

10. A stencil printer as defined in claim 1 in which the stencil printer further comprises an ink viscosity input means for manually inputting a viscosity of the ink, and the internal press roll drive means changes the distance between the axis of rotation of the printing drum and the second position according to the viscosity of the ink input through the ink viscosity input means.

11. A stencil printer as defined in claim 10 in which the viscosity of the ink is represented by the electric current supplied to the electric motor for driving the printing drum or to the electric motor for supplying the ink to the printing drum.

12. A stencil printer as defined in claim 1 in which the stencil printer further comprises a wear detecting means which detects the amount of wear of the internal press roll and the internal press roll drive means changes the distance between the axis of rotation of the printing drum and the second position according to the amount of wear of the internal press roll detected by the wear detecting means.

13. A stencil printer as defined in claim 12 in which the wear detecting means detects the amount of wear of the internal press roll on the basis of the cumulative number of times of printing.

14. A stencil printer as defined in claim 1 in which the stencil printer further comprises a wear input means for manually inputting the amount of wear of the internal press roll, and the internal press roll drive means changes the distance between the axis of rotation of the printing drum and the second position according to the amount of wear of the internal press roll input through the wear input means.

15. A stencil printer as defined in claim 14 in which the amount of wear is estimated on the basis of the cumulative number of times of printing.

16. A stencil printer as defined in claim 1 in which the stencil printer further comprises an original type setting means which sets the type of the original, and the internal press roll drive means changes the distance between the distance between the axis of rotation of the printing drum and the second position according to the type of the original set by the original type setting means.

17. A stencil printer as defined in claim 1 in which the stencil printer further comprises an original type input means for manually inputting the type of the original, and the internal press roll drive means changes the distance between the axis of rotation of the printing drum and the second position according to the type of the original input through the original type input means.

18. A stencil printer as defined in claim 1 in which the rotation control means is a pulse motor.

* * * * *